US006666536B2

(12) United States Patent
Nakanishi et al.

(10) Patent No.: US 6,666,536 B2
(45) Date of Patent: Dec. 23, 2003

(54) INK JET DEVICE WITH MOVABLE PLATEN

(75) Inventors: Kenji Nakanishi, Sakurai (JP); Yasushi Matsutomo, Nara (JP); Susumu Hashimoto, Yamatotakada (JP); Masanobu Deguchi, Kashiba (JP); Takashi Kubo, Kyoto (JP); Yasuaki Fukada, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/927,356

(22) Filed: Aug. 13, 2001

(65) Prior Publication Data

US 2002/0030706 A1 Mar. 14, 2002

(30) Foreign Application Priority Data

Aug. 24, 2000 (JP) ..... 2000-254125
Jun. 20, 2001 (JP) ..... 2001-186852

(51) Int. Cl.[7] ..... B41J 25/308
(52) U.S. Cl. ..... 347/8
(58) Field of Search ..... 347/8, 104; 400/55, 400/56, 57, 58, 59, 60, 579, 645, 645.3, 645.4

(56) References Cited

U.S. PATENT DOCUMENTS 4,620,807 A * 11/1986 Polit ..... 400/56
5,873,665 A * 2/1999 Aizawa et al. ..... 400/645
5,940,092 A * 8/1999 Kashimura et al. ..... 347/8
5,980,132 A * 11/1999 Kawai ..... 347/8

FOREIGN PATENT DOCUMENTS

JP 03234681 A 10/1991
JP 08300768 A 11/1996
JP 09109460 A 4/1997

* cited by examiner

*Primary Examiner*—Stephen D. Meier
*Assistant Examiner*—Julian D. Huffman
(74) *Attorney, Agent, or Firm*—Birch, Stewart, Kolasch & Birch, LLP

(57) ABSTRACT

A pair of drive conveyer rollers are provided for a platen that guides recording media. The follower conveyer roller is supported by a roller support plate which is coupled at its side with a lever so that the rotation of this lever is able to press the platen downward. When the paired drive conveyer rollers hold recording paper between them, the follower conveyer roller moves upward, which causes the roller support plate to rotate. This rotational force is transmitted to the lever so that the platen is pressed down to thereby adjust the gap between the printer head and the platen appropriately.

21 Claims, 16 Drawing Sheets

INK JET DEVICE WITH MOVABLE PLATEN

BACKGROUND OF THE INVENTION (1) Field of the Invention

The present invention relates to an ink-jet image forming apparatus for forming images on recording paper by ejection of ink droplets. In particular, the present invention relates to a method of performing stable image formation by keeping the distance between the recording head and recording paper constant at all times without regard to the type of recording paper.

(2) Description of the Prior Art

In general, in an image forming apparatus of an ink-jet type(to be referred to hereinbelow as ink-jet printers) which can form micro dots at high densities while making relatively low noise during printing, image forming is performed by ejecting ink droplets onto the surface of recording sheets which are fed successively. More specifically, a generally known scenario is that the recording head, which is set with an ink cartridge on a carriage, ejects ink droplets onto the recording paper that moves intermittently in the auxiliary direction while the carriage reciprocates in the main scan direction that is perpendicular to the direction of conveyance of the recording paper.

As the ink cartridge, one which supplies black ink and color inks, i.e., yellow, cyan and magenta is provided. Accordingly, an ink-jet printer not only produces text printing with black ink but also is able to perform full color printing by adjusting the ratio of the amounts of color inks ejected toward the recording paper.

In ink-jet printers of this type, the distance between the position of the ink nozzle of the ink head and the recording paper surface (head to medium gap) can be considered one of the critical factors that determine the print quality.

Since the sheets to be used for ink-jet printers are generally diverse, from typical recording paper (e.g., about 0.05 to 0.2 mm thick) to postcards, envelopes, etc., the distance from the ink nozzle position of the recording head to the recording paper surface varies due to variations in sheet thickness. Further, an ink droplet ejected from the ink nozzle to the recording paper varies in its shape and speed depending on the head to medium gap. For these reasons, setting of the head to medium gap is critically important to obtain the shape and speed of ink droplets suitable for printing.

Illustratively, when the head to medium gap is narrow, the speed at which an ink droplet reaches the recording paper remains high, so that ink droplet splashes on the recording paper surface. That is, ink may scatter over the non-printing area beyond the area on the sheet that the ink droplet should be ejected onto for printing, or may contaminate the recording head.

On the other hand, when the head to medium gap is wide, the actual travel route of the ink droplet ejected from the carriage whilst it is being moved deviates from the expected path. Since the point at which the ink droplet arrives thus deviates from the proper position, this will cause distortion in the resulting image.

In order to prevent degradation of print quality due to inappropriate head to medium gap, there have been many proposals up to now for adjusting the head to medium gap in the technical field of ink-jet printers.

For example, there is a method of adjustment as to the head to medium gap by manually switching the height of the recording head in accordance with the thickness of the recording paper to be used for printing. This method involves selection modes such as 'thick paper mode', 'normal paper mode', 'thin paper mode', etc., so as to allow the user to select the desired mode with a lever handle.

Japanese Patent Application Laid-Open Hei 9 No.109460 discloses an ink-jet printer configuration in which the carriage or recording head is moved in accordance with the head to medium gap detected by a sensor so as to adjust the distance to the user-desired text size to be printed.

However, as to the configuration in which the height of the recording head is manually selected, the user needs to decide the thickness of the recording paper in order to obtain beneficial print quality. Accordingly, this configuration needs complicated print handling and potentially can cause breakdown of the recording head due to user's misjudgment. When switching of the height of the recording head is performed by shifting the carriage up and down, the whole carriage configuration inevitably becomes complicated, which leads to a marked rise in manufacturing cost. Further, the change of the height of the carriage could hinder the stability of the scanning movement of the carriage in the main scan direction and may cause degradation of image quality. Further, in the waiting mode the carriage is positioned at a maintenance station located at one side with respect to the main scan direction, however there is a possibility that the carriage cannot be set at an appropriate position relative the maintenance station when the height is changed. In order to avoid this, it is necessary to make the height of the maintenance station adjustable or provide other measures, hence the result is complexity of the entire printer.

In the configuration disclosed in the above publication, part of the sensor for detecting the head to medium gap and the mechanical arrangement for adjusting the head to medium gap are mounted on the carriage for moving the recording head. Therefore, the carriage needs to carry the sensor and the mechanical arrangement together with the recording head, thus consuming extra electric energy.

SUMMARY OF THE INVENTION

The present invention has been devised in view of the above problems, it is therefore an object of the present invention to provide an ink-jet image forming apparatus with which the distance between the recording head and recording paper can be kept constant at any time regardless of the type of recording paper without increasing in any way the complexity of the carriage configuration and without inducing any increase in power consumption.

In order to achieve the above object, in the present invention, the platen for guiding the recording paper is moved in the direction away from the recording head so as to set the gap between the recording head and recording paper at a proper distance.

Specifically, the invention is assumed to involve an ink-jet type image forming apparatus having a platen for guiding recording media and a recording head disposed opposing the platen for ejecting ink droplets onto recording media. This ink-jet type image forming apparatus is provided with a platen actuating means which moves the platen so as to adjust the gap between the recording head and the recording medium.

By this limitation, it becomes possible to adjust the distance between the ink nozzle position of the recording head and the recording medium surface on the platen (the head to medium gap) and set it constant by moving the platen which will serve as a guide table for recording media during printing(during image forming) and keep the recording medium flat and adjust the height of the recording medium relative to the ink nozzle. With this arrangement, it is possible to perform printing of different types of recording media having different thicknesses under the same conditions. In the present invention, since the head to medium gap can be set correctly without shifting the recording head or the carriage having the recording head mounted thereon, there is no need to provide a motor or other parts in order to drive the recording head or the carriage up and down. Therefore, it is possible to avoid increase of the carriage in weight, hence increase in power consumption can be inhibited while the carriage can be moved smoothly. Here, examples of applicable recording media include, recording paper, OHP film and any other material as long as it is printable by sprayed ink.

Specific examples of the platen actuating means include the following configurations. First, the ink-jet type image forming apparatus may further include paired conveyer rollers for holding the recording medium being image formed by ejected ink droplets from the recording head and conveying it. In this arrangement, the platen actuating means is adapted to move the platen in linkage with the holding operation of the recording medium between the paired conveyer rollers and set the gap between the recording head and the recording medium at a predetermined distance.

Also, the ink-jet type image forming apparatus may further include a thickness detecting means for detecting the thickness of the recording medium from the clearance between the paired conveyer rollers when a recording medium has been held between the pairs of rollers. In this arrangement, the platen actuating means is adapted to move the platen based on the thickness of the recording medium detected by the thickness detecting means and set the gap between the recording head and the recording medium at a predetermined distance.

Each of the platen actuating means is configured to move the platen so as to keep the gap between the recording head and the recording medium always constant regardless of the thickness of the recording medium.

The platen actuating means specifically operates in the following manners. First, the platen actuating means, in linkage with the movement of the paired conveyer rollers separating from one another by the thickness of the recording medium when a recording medium is held between the paired conveyers rollers, moves the platen by the distance substantially corresponding to the movement of separation to thereby set the gap between the recording head and the recording medium at the predetermined distance.

As another action, the platen actuating means, using the force arising when the paired conveyer rollers separate from one another by the thickness of the recording medium when a recording medium is held between the paired conveyers rollers, drives the platen by the distance substantially corresponding to the movement of separation to thereby set the gap between the recording head and the recording medium at the predetermined distance.

These limitations enable the platen actuating means to operate so as to keep the gap between the recording head and the recording medium surface constant regardless of the type (the thickness) of the recording medium, hence it is possible to keep the travel time of an ink droplet from its being ejected from the recording head to its arrival at the recording medium constant. Therefore it is possible to place the ink droplet at the designated position, leading to improvement of the quality of image forming. It is also possible to avoid the recording medium, during conveyance, interfering with the recording head and hence being mis-fed or damaging the recording head to too short a gap between the recording head and recording medium.

The paired conveyer rollers are arranged at a position upstream of the recording head with respect to the direction of conveyance of the recording medium. By this limitation, the recording medium has already been held between the paired conveyer rollers when the recording medium reaches the position where it opposes the recording head. That is, image forming by ink droplets being ejected from the recording head to the recording medium is carried out when the platen movement in linkage with the holding between these paired conveyer rollers has been completed. As a result, it is possible to perform beneficial image forming from the leading part (the downstream end with respect to the direction of conveyance) of the recording medium.

Further specific examples of the platen actuating means include the following configurations. That is, the platen actuating means may include a linkage mechanism for linking the platen actuating movement with the movement of the paired conveyer rollers separating one from the other. This linkage mechanism may include: a first linkage for axially supporting a first conveyer roller of the paired conveyer rollers; and a second linkage which is coupled with the first linkage and presses and moves the platen in linkage with the movement of the first linkage as the first conveyer roller moves when a recording medium is held by the paired conveyer rollers.

Thus, these limitations enables a relatively simple configuration, that is, the linkage mechanism, to realize a mechanism for always keeping the gap between the recording head and the recording medium surface constant.

The means for supporting the platen actuating means can be configured as follows. First, a platen clutching means for keeping the platen at a position at which the platen has been shifted by the platen actuating means may be provided.

By this limitation, the position of the platen having been shifted can be retained by the platen clutching means even after the holding of the recording medium between the paired conveyer rollers is released. Therefore, it is possible to keep the proper gap from the recording medium to the recording head even at the rear part of the recording medium (the upstream part with respect to the conveying direction), hence perform beneficial image forming.

Specific examples of the platen clutching means include the following configurations. The platen clutching means may be comprised of paired discharge rollers arranged on the output side of the platen and may be configured such that one of the discharge rollers is rotationally supported by the platen. Further, the paired discharge rollers may be adapted to hold the recording medium and convey it when the holding of the recording medium by the paired conveyer rollers is released.

By these limitations, when the recording medium is being held between by the discharge rollers, one of the discharge rollers moves together with the platen by the distance corresponding to the thickness of the recording medium. This movement of the platen makes it possible to keep the proper gap between the recording medium and the recording head.

Other specific examples of the platen clutching means are configured as follows. That is, the platen clutching means may have a movement direction limiting element which allows the platen to move only in the direction away from the recording head.

The platen clutching means may have a releasing means for releasing the constraint imposed by the movement direction limiting element so as to allow the platen to move closer and back to the recording head. This releasing means is comprised of a release roller put in sliding contact with the movement direction limiting element and a drive roller rotating the release roller in linkage with the paper feed roller so that the constraint imposed by the movement direction limiting element is released by the release roller sliding into contact with the movement direction limiting element as the drive roller turns in linkage with the movement of the paper feed roller. Further, the movement direction limiting element may be comprised of a one-way clutch mechanism.

By these limitations, the position of the platen having been shifted can be retained even after the holding of the recording medium between the paired conveyer rollers is released. Further, provision of the releasing means always makes it possible to move the platen by the distance corresponding to the thickness of an individual recording medium.

When each of the above configurations further includes a movement limiting means for limiting the amount of movement of the platen by the platen actuating means, it is possible to avoid platen deformation which would be caused when the platen moved further than needed.

The platen actuating means may have a linkage mechanism for coupling the movement of the platen in linkage with the movement of the paired conveyer rollers when they separate from one another while the movement limiting means is adapted to abut this linkage mechanism to limit the movement of the linkage mechanism. This arrangement enables a relatively simple configuration to avoid the platen moving further than needed.

In the case where a bowing regulating structure for covering the non-image forming area on the recording medium is provided so that the gap between the recording head and the surface of the recording medium conveyed over the platen will be prevented from becoming narrower than a predetermined distance, it is possible to keep the head to medium gap equal to or wider than the predetermined distance. This provides an assisting function for setting the head to medium gap properly. Further, since the bowing regulating structure is arranged so as to cover the non-image forming area on the recording medium, the presence of this bowing regulating structure will never interfere with the printing operation.

The paired conveyer rollers comprise a drive roller and follower roller, the linkage mechanism has an adjuster element which is pivotally supported by the machine housing with its one end rotatably supporting the follower roller and the other end coupled with the platen. When a recording medium is held between the paired conveyer rollers, the follower roller moves by the thickness of the medium relative to the drive roller, whereby the adjuster element pivots following the movement of the follower roller to cause the platen to move away from the recording head.

In this configuration, when the adjuster element is configured so that the distance of movement of the platen with the rotation of the adjuster element is adapted to be equal to the thickness of the recording medium, the follower roller moves by the distance corresponding to the thickness of the recording medium when the recording medium is held between the paired conveyer rollers. This movement causes the adjuster element to turn so that the platen moves away from the recording head. The amount of movement of the platen is greater as the recording medium is thicker, thus it is possible to move the platen properly in accordance with the thickness.

In the case where an elastic element which provides thrust to cause the platen to approach the recording head is arranged, even if the amount of movement of the follower roller becomes greater than the thickness of the recording medium (even if the platen would move down excessively), it is possible to adjust the platen at a proper position by the thrust from the elastic element.

In the case where a feed direction regulating structure on which the recording paper side parallel with the direction of conveyance of the recording paper being conveyed over the platen is abutted, is provided, so as to prevent the recording paper from skewing or moving zigzagedly, the recording medium is prevented from moving sidewards or obliquely. As a result, it is possible to perform image forming always under fixed conditions whilst the recording medium being stably conveyed.

Another specific example of the platen actuating means may include a platen support structure for supporting the platen by placement thereon, so that the platen will move down by gravity as the platen support structure moves down away from the recording head, to thereby set the gap between the recording head and the recording medium at a predetermined distance.

This configuration also makes it possible to perform printing of different types of recording media having different thicknesses under the same conditions. Further, in the present invention, since fixed print conditions can be established without shifting the recording head or the carriage having the recording head mounted thereon, there is no need to provide a motor or other parts in order to drive the recording head or the carriage up and down. Therefore, it is possible to avoid increase of the carriage in weight, hence increase in power consumption can be inhibited while the carriage can be moved smoothly.

This configuration may further includes: paired conveyer rollers for holding therebetween a recording medium being image formed by ejected ink droplets from the recording head and conveying it; a thickness detecting means for detecting the thickness of the recording medium from the clearance between the conveyer rollers when a recording medium has been held between the pairs of rollers, wherein the platen actuating means moves the platen support structure downward based on the thickness of the recording medium detected by the thickness detecting means and sets the gap between the recording head and the recording medium at a predetermined distance.

Further, the platen support structure may be adapted to support the underside of the platen at multiple sites. This configuration is able to prevent the platen from being twisted and prevent the upper surface of the platen from being positioned at different heights when the platen is moved up and down. Therefore, the head to medium gap can be set to be practically uniform across the entire printing area, thus making it possible to perform printing over the whole page of the recording medium under the same conditions.

Also, the paired conveyer rollers may comprise a drive roller and follower roller while an adjuster element which is pivotally supported by the machine housing with its one end rotatably supporting the follower roller and the other end coupled with the platen support structure is provided. When a recording medium is held between the paired conveyer rollers, the follower roller moves by the thickness of the medium relative to the drive roller. The adjuster element pivots following the movement of the follower roller so that the platen support structure moves downward to thereby set the gap between the recording head and the recording medium at the predetermined distance.

In this case, the adjuster element is configured so as to cause the platen support structure to move downwards one to one and half times greater than the distance of movement of the follower roller relative to the drive roller.

In this case, when a recording medium has become held between the paired conveyer rollers, the thickness of recording medium decreases slightly from the pressure by the paired conveyer rollers. In order to compensate this, the distance of downward movement of the platen support element is set to be 1.0 to 1.5 times of the distance of movement of the follower roller, so that the amount of pivot of the adjuster element will be suitable for the thickness of the recording medium.

Since an elastic element which provides upward thrust to cause the platen support structure to approach the recording head is provided, even if the amount of movement of the follower roller becomes greater than the thickness of the recording medium (even if the platen would move down excessively), it is possible to adjust the platen at a proper position by the thrust from the elastic element.

In the case where the thrust from the elastic element is adapted to press the follower roller of the paired conveyer rollers against the drive roller, a relatively thick recording medium will be held between the conveyer rollers with a greater grip, whereas a relatively thin recording medium will be held between the conveyer rollers with a lower grip. In this way, it is possible to convey a recording medium by a proper holding force in accordance with the thickness of the recording medium.

In the case where a platen position limiting structure for limiting the position of the platen so as to keep the gap between the platen upper surface and recording head equal to or shorter than the predetermined distance is provided, even if the amount of movement of the platen is too large(even if the platen would move upward excessively), it is possible to limit the platen position limiting structure within the predetermined range, so as to prevent the platen from interfering with the ink nozzles of the recording head.

The position, on the platen, limited by the platen position limiting structure is arranged directly above the platen support site by the platen support structure. Therefore, by arranging the constraint point and support point at almost the same area, it is possible to prevent the platen from being twisted and prevent the upper surface of the platen from being positioned at different heights, hence prevent the platen from interfering with the ink nozzles of the recording head.

Finally, the position, on the platen, limited by the platen position limiting structure is arranged at a position away from the feed area of the recording media on the platen. Thus it is possible to limit the position of the platen without damaging the recording medium being conveyed over the platen.

DESCRIPTION OF THE PREFERRED EMBODIMENTS

The embodiments of the present invention will hereinafter be described with reference to the accompanying drawings. In the embodiments, description will be made concerning the cases where the present invention is applied to a color ink-jet printer as a typical image forming apparatus.

(The First Embodiment)

First, the first embodiment of the present invention will be explained.

Description of the Overall Configuration of a Color Ink-Jet Printer

Figure 1:
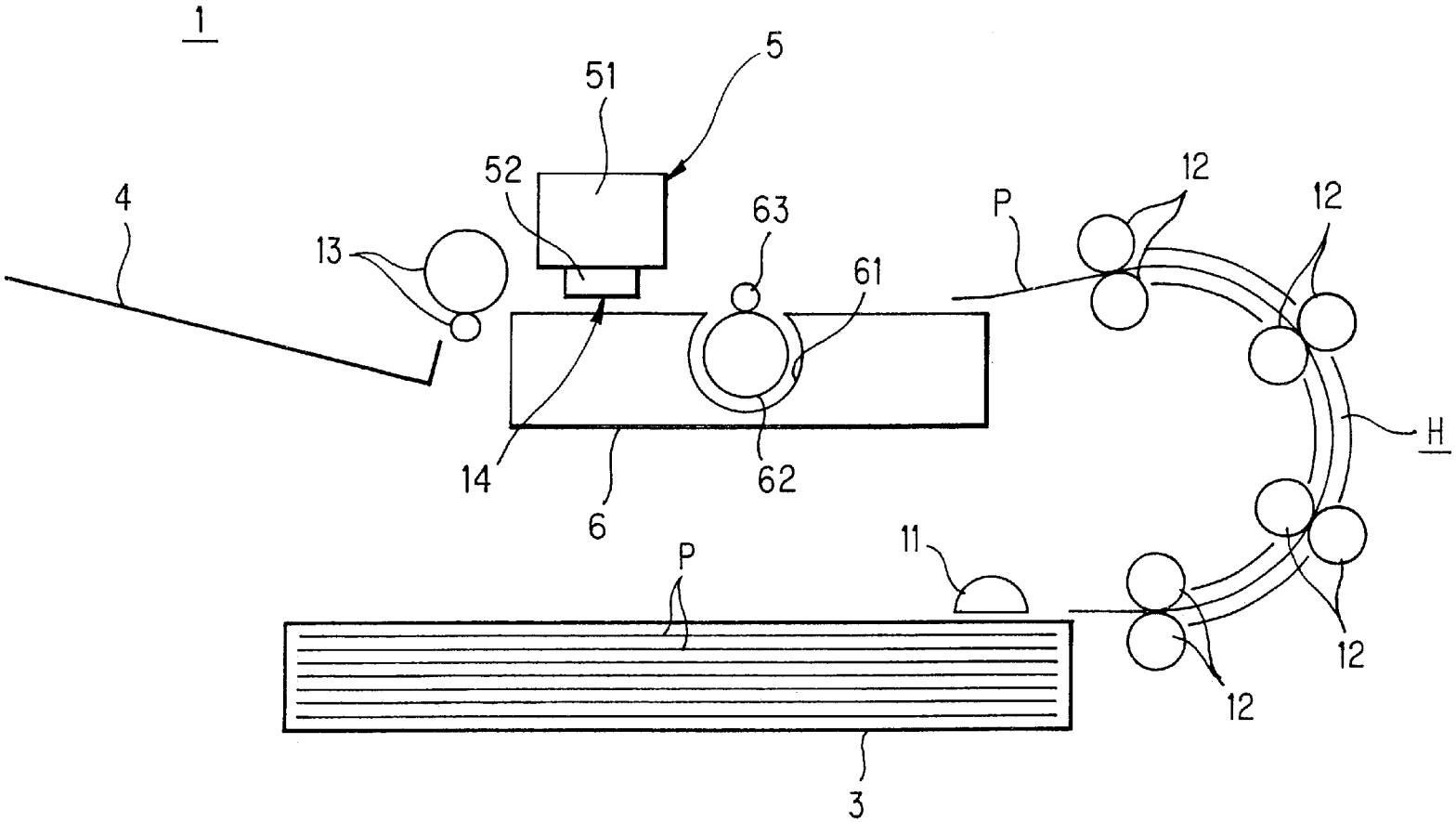
FIG. 1 is a schematic view showing an internal configuration of a color ink-jet printer in accordance with the embodiment.

To begin with, the overall configuration of a color ink-jet printer 1 in accordance with the embodiment will be described with reference to FIG. 1. FIG. 1 is a schematic view showing an internal configuration of the color ink-jet printer.

This color ink-jet printer 1 has a paper feed cassette 3 on the front side (on the left in FIG. 1) and further includes a paper output tray 4 over paper feed cassette 3 on this front side. Arranged from paper feed cassette 3 to paper output tray 4 are a pickup roller 11 having a semicircular cross-section, multiple pairs of conveying rollers 12, 12, . . . , arranged along a conveyance path H formed in a substantially U-shape, an unillustrated PS roller, an ink-jet mechanism 5, a pair of discharge rollers 13, in the order mentioned. Each roller pair 12 and 13 is composed of a drive roller connected to an unillustrated drive source such as a drive motor etc., and a follower roller in contact with the drive roller.

Arranged under ink-jet mechanism 5 is a flat platen 6 for guiding recording paper P as recording media. As shown also in FIG. 2, part of the top surface of this platen 6 is cut out with a hollow 61 having a circular cross-section, in which a drive conveyer roller 62 is accommodated. A follower conveyer roller 63 is arranged over the drive conveyer roller 62 so that recording paper P is conveyed over platen 6 by being held between the drive conveyer roller 62 and follower conveyer roller 63. The drive conveyer roller 62 and follower conveyer roller 63 constitute the paired conveyer rollers defined in the present invention. The held position of recording paper P between the drive conveyer roller 62 and follower conveyer roller 63 approximately coincides with the height of the top surface of platen 6. The drive conveyer roller 62 and follower conveyer roller 63 are arranged on the upstream side of ink-jet mechanism 5 with respect to the recording paper feed direction.

The above ink-jet mechanism 5 has an unillustrated guide shaft extended in the main scan direction of carriage 51 (in the direction perpendicular to the document surface of FIG. 1), so that carriage 51 is able to reciprocate in the main scan direction while being guided by this guide shaft.

This carriage 51 holds a recording head 52 and unillustrated ink cartridges(ink tanks). Specifically, carriage 51 has four ink cartridges, separately storing Y(yellow), M(magenta), C(cyan) and Bk(black) inks, respectively, arranged side by side in the main scan direction. Recording head 52 further has multiple nozzles which are separately connected to these ink cartridges by way of unillustrated supply paths.

Arranged on one side in the main scan direction of carriage 51 is an unillustrated maintenance station. Carriage 51 is placed so as to oppose this maintenance station opposes during non-operation(waiting mode) of printer 1 so that the station caps recording head 52 and provides other functions in order to prevent dryout of ink in recording head 52.

The present embodiment is characterized by provision of a platen actuating means 7 (also referred to as a means for actuating the platen) for moving platen 6 when recording paper P is held and conveyed between the aforementioned drive conveyor roller 62 and follower conveyer roller 63. Next, this platen actuating means 7 will be described.

Description of the Configuration of Platen Actuating Means 7

Figure 2:
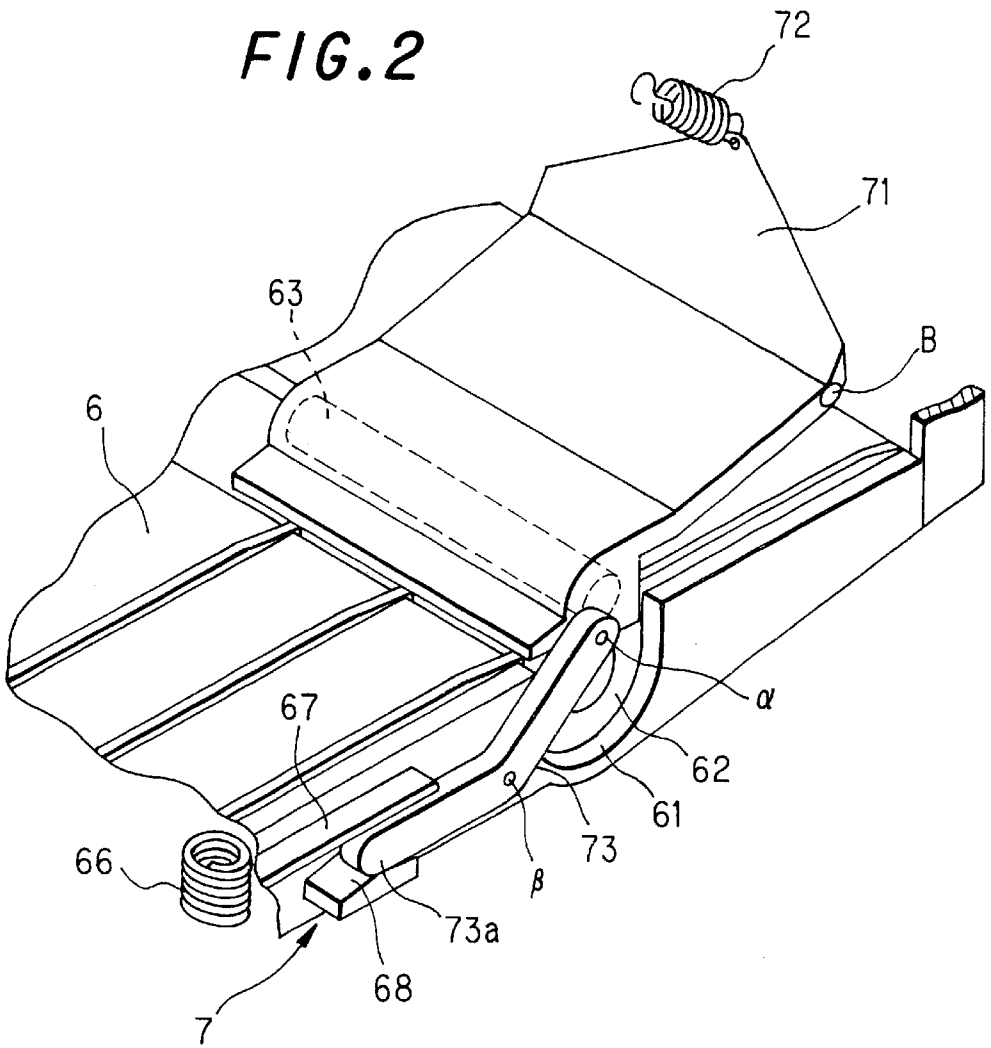
FIG. 2 is a perspective view showing the arrangement of a platen actuating means in accordance with the first embodiment.
Figure 3:
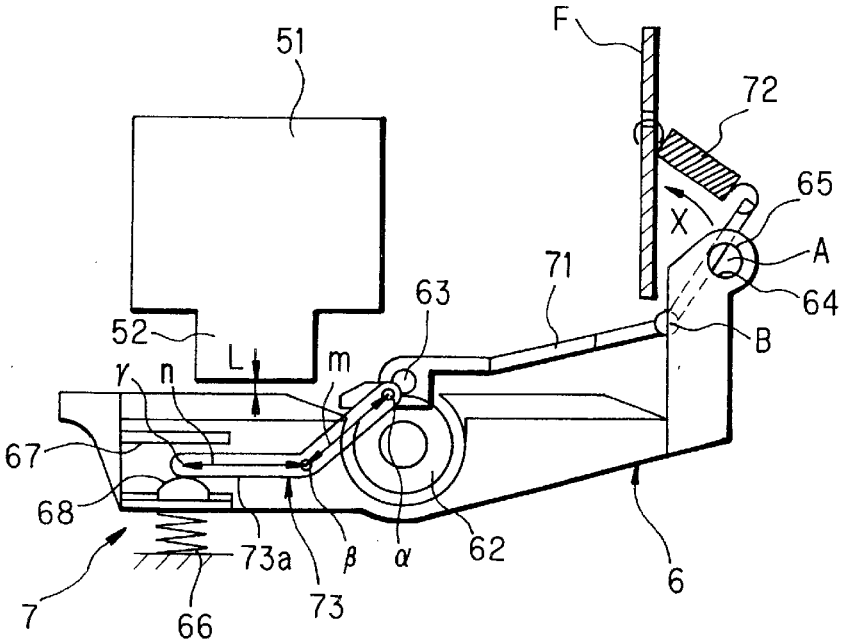
FIG. 3 is a side view for illustrating the operation of a platen actuating means with no recording sheet passing.
Figure 4:
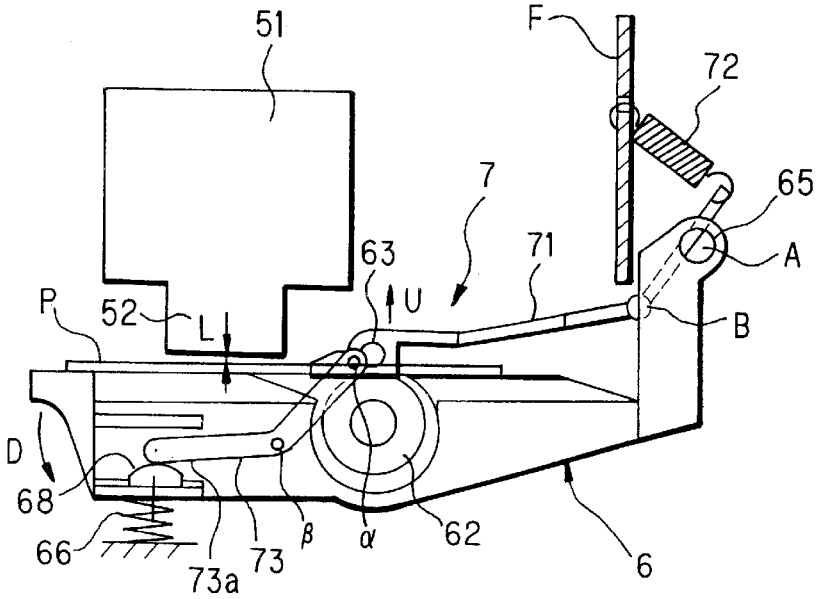
FIG. 4 is a side view for illustrating the operation of a platen actuating means with a recording paper passing.

FIG. 2 is a perspective view showing the arrangement of platen actuating means 7. FIGS. 3 and 4 are side views for illustrating the operation of platen actuating means 7, FIG. 3 representing a state with no recording paper P passing (during waiting) and FIG. 4 representing a state with a recording paper P passing (during image forming).

As shown in these figures, platen 6 has a shaft receiving bore 64 extending in the main scan direction on the upstream end (on the right end in FIG. 3) with respect to the conveying direction of recording paper. A shaft 65 is fitted into this shaft receiving bore 64 so that the platen is supported rotatably on the horizontal axis. A compression coil spring 66 is compressed and arranged so as to abut the undersurface of platen 6 at the downstream end (on the left end in FIG. 3) with respect to the conveying direction of recording paper. Thus, a thrust is applied to rotate platen 6 in the clockwise direction (in a direction so as to raise it) about the support point A in FIG. 3. This thrust keeps the predetermined distance (gap L in the drawing) between recording head 52 and platen 6 when no recording paper P passes (see FIG. 3).

The aforementioned follower conveyer roller 63 is comprised of multiple roller elements across its length in the main scan direction (one element of follower conveyer roller 63 is shown in FIG. 2). Each element of follower conveyer roller 63 is rotatably supported at one end (on the left end in FIG. 3) of a roller support plate 71 as the first linkage. This roller support plate 71 is rotatably supported by the unillustrated printer frame(housing) at a horizontal axis arranged in its halfway point in the left-to-right direction in FIG. 3 (at a support point B shown in FIG. 3). Further, a tensile coil spring 72 is engaged at the right end of this roller support plate 71 as shown in FIG. 3 while the other end of tensile coil spring 72 is hooked at printer frame F. With this arrangement, a thrust acting in the counterclockwise direction in FIG. 3 (see an arrow X in FIG. 3) is applied to roller support plate 71. This thrust acts in such a direction as to press follower conveyer roller 63 against drive conveyer roller 62.

Among the multiple roller support plates 71 provided for each element of follower conveyer roller 63, the roller support plate 71 arranged at one end in the main scan direction (the roller support plate 71 arranged on front-most side in FIG. 2) is coupled with a lever 73 as the second linkage for transmitting the force (to be described later) acting on this roller support plate 71 to platen 6. This lever 73 is a bent (open-V shaped) element and is rotatably coupled with roller support plate 71 at its one end (at the position a in FIG. 3) while the bent portion at the midpoint (at the position β in FIG. 3) is axially supported by the printer frame(housing). The other end of this lever 73 (at the position γ in FIG. 3) forms a pressing portion 73*a* which can contact with aftermentioned abutment portions 67 and 68 provided for platen 6.

With this arrangement, when recording paper P is conveyed over platen 6 as shown in FIG. 4, this recording paper P is held between drive conveyer roller 62 and follower conveyer roller 63 and the follower conveyer roller 63 rotates clockwise (in the direction of an arrow U) together with roller support plate 71 about support point B in FIG. 4 by the distance corresponding to the gap(clearance) between drive conveyer roller 62 and follower conveyer roller 63. That is, as recording paper P passes, an upward force acts on follower conveyer roller 63 and this force rotates roller support plate 71 in the clockwise direction in FIG. 4. Then lever 73 is caused by the force from roller support plate 71 to rotate about a support point β in the counterclockwise direction and press down the aftermentioned lower abutment portion 68 of platen 6 opposing the pressure from compression coil spring 66. Thus the linkage mechanism termed in the present invention is configured by the above roller support plate 71 and lever 73. The thickness detecting means termed in the present invention is configured by the above drive conveyer roller 62 and follower conveyer roller 63.

Platen 6 has on its side face an upper abutment portion 67 as a movement limiting means provided over pressing portion 73*a* of lever 73 and a lower abutment portion 68 located under pressing portion 73*a*. That is, pressing portion 73*a* is adapted to be able to abut the upper abutment portion 67 or lower abutment portion 68 when lever 73 rotates.

As described above, since the pressure from compression coil spring 66 is applied to platen 6 in such a direction as to spring the platen upward, pressing portion 73*a* of lever 73 is kept abutting the lower abutment portion 68. Since ordinary recording paper P is 0.1 to 0.4 mm thick, pressing portion 73*a* of lever 73 will not abut the upper abutment portion 67 in this range. In contrast, when the thickness of recording paper P falls out of the above range, platen 6 moves down by that thickness so that platen 6 receives an excessive load from compression coil spring 66. In this case, there might be a concern that deformation of platen 6 will occur, but if lever 73 is pressed down more than the predetermined amount, upper abutment portion 67 of platen 6 abuts pressing portion 73*a* of lever 73 so as to limit the rotation of lever 73, preventing platen 6 from moving further downward, whereby deformation of platen 6 can be avoided.

Though lever 73 described above is provided only for the roller support plate 71 arranged on the most front side in FIG. 2, another lever 73 (not shown in the drawing) may be provided for the roller support plate 71 arranged on the most interior side. In this case, upper and lower abutment portions 67 and 68 should also be provided for the interior side of platen 6.

Description of the Printing Operation

When the printing operation of this color ink-jet printer 1 is started, one sheet of recording paper P is picked up from paper feed cassette 3 by pickup roller 11 and conveyed along feed path H by paired conveyer rollers 12. Then, the leading edge of this recording paper P is registered with the image information (data transferred from an unillustrated computer etc.) by means of the PS roller and then conveyed to an image forming station 14, where the paper opposes recording head 52. When recording paper P passes through image forming station 14, multiple colors of inks are ejected from individual nozzles provided on recording head 52, based on the position of recording paper P and image information, whereby image is formed on the surface of recording paper P.

Now, this image forming operation will be described more specifically. When recording paper P is conveyed to image forming station 14, the nozzles eject ink droplets onto the recording paper P whilst carriage 51 is moving outward along the main scan direction (e.g., in the direction away from the reader in FIG. 1), performing image forming on recording paper P. When carriage 51 reaches one end of recording paper P, the recording paper P moves (is conveyed in the auxiliary direction) by the predetermined amount and stops. Then, as carriage 51 is moved homeward along the main scan direction (e.g., in the direction towards the reader in FIG. 1), image forming is performed. In this way, image forming actions resulting from movement of carriage 51 and actions of feeding recording paper P are effected alternately so as to form an image over the entire surface of recording paper P.

Recording paper P with an image formed on substantially the whole surface thereof is discharged toward paper output tray 4 by means of paired discharge rollers 13. Thus, recording paper P completed with a proper image is discharged faceup (with its image formed surface set upward) onto paper output tray 4.

Next, the operation of platen actuating means 7 when the recording paper P has been fed to image forming station 14 will be explained. When recording paper P has been fed onto platen 6, this recording paper P is held between drive conveyer roller 62 and follower conveyer roller 63 and conveyed downward along the conveyance path by the rotational drive of drive conveyer roller 62. During this, follower conveyer roller 63 rotates together with roller support plates 71 in the clockwise direction (see the arrow U in the drawing) about support point B in FIG. 4 in proportion to the thickness of recording paper P. With this movement, lever 73 coupled to roller support plate 71 also rotates counterclockwise about support point β by the force from roller support plates 71. Hence, pressing portion 73*a*of lever 73 presses down lower abutment portion 68 of platen 6 opposing the pressure from compression coil spring 66.

As a result, platen 6 rotates about support point A in the counterclockwise direction in the drawing, whereby the distance between recording head 52 and the opposing recording paper P surface is kept at the predetermined distance L determined by the dimensions m and n (see FIG. 3) of the parts of lever 73. In this way, platen 6 moves downwards by the distance corresponding to the thickness of recording paper P, and with this state, image forming actions resulting from the above movement of carriage 51 and actions of feeding recording paper P are effected alternately so as to form an image over the entire surface of recording paper P.

Here, the ratio between the distance m from the coupling point (position α) of lever 73 with roller support plate 71 to support point (position β) and the distance n from the pressing portion (position γ) to support point (position β) is adjusted so as to keep the gap between recording head 52 and the opposing recording paper P surface at the predetermined distance L, regardless of the thickness of any recording paper P being conveyed.

Effects of the Embodiment

Since platen 6 moves down by the distance corresponding to the thickness of recording paper P as described above, it is possible to keep the travel time of an ink droplet from its being ejected from recording head 52 to its arrival at recording paper P constant regardless of the thickness of recording paper P used, hence it is possible to place the ink droplet at the designated position. Therefore, it is possible to improve the quality of image forming. It is also possible to avoid recording paper P, during conveyance, interfering with recording head 52 and hence being mis-fed or damaging recording head 52 due to too short a gap between recording head 52 and recording paper P. Moreover, proper setting of the head to medium gap makes it possible to achieve an appropriate speed of the ink droplet landing onto recording paper P, hence prevent ink droplets from splashing on the recording paper. Thus, improved image formation can also be obtained from this viewpoint too.

Since the height or position of carriage 51 is not adjusted, there is no concern of the whole carriage 51 system being complicated. Therefore, the stability of the scanning operation of carriage 51 can be assured and maintained. This also contributes to improvement of image forming. That is, the printer in which the height of carriage 51 is adjusted needs to have a height adjustable maintenance station or other alternative means, but the present embodiment does not need such arrangement, so that it is possible to simplify the total printer configuration.

(The Second Embodiment)

Figure 5:
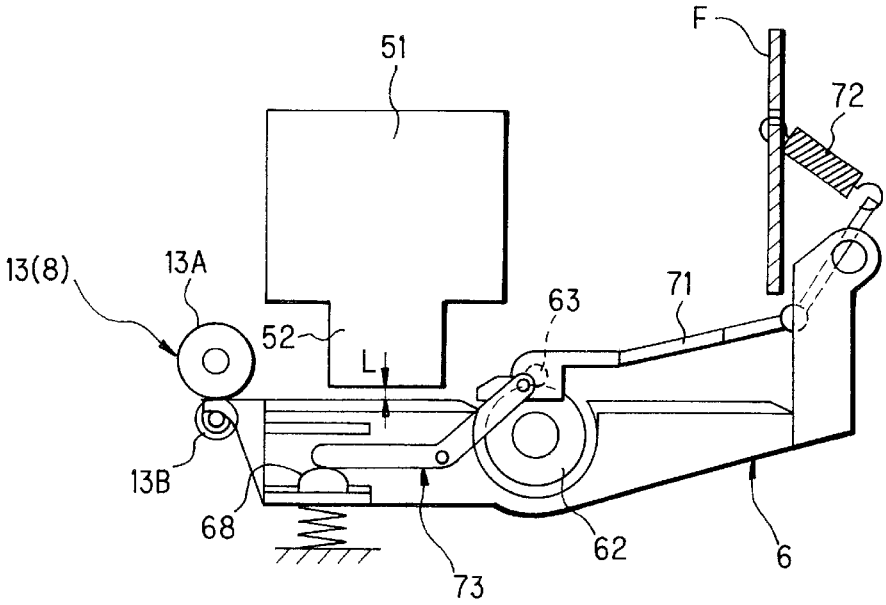
FIG. 5 is a side view for illustrating the operation of a platen clutching means in accordance with the second embodiment, with no recording paper passing.
Figure 6:
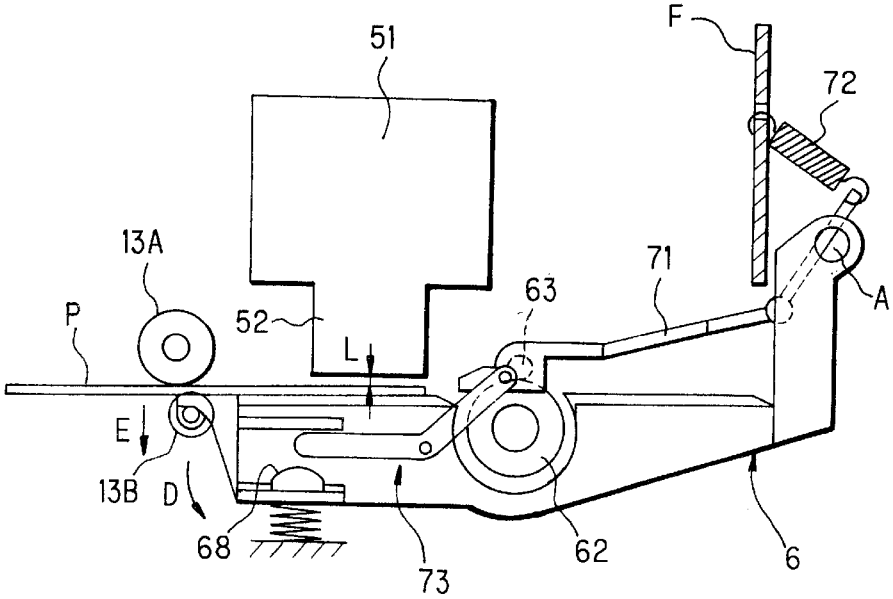
FIG. 6 is a side view for illustrating the operation of a platen clutching means in accordance with the second embodiment with recording paper passing.

Referring next to FIGS. 5 and 6 the second embodiment of the present invention will be described. In this embodiment, the paired discharge rollers 13 arranged downstream of platen 6 are made to function as a platen clutching means 8. Other configurations are the same as in the first embodiment described above. Therefore, description will be made focusing only on the configuration of the paired discharge rollers 13 and their function.

These paired discharge rollers 13 comprise a drive discharge roller 13A located above and a follower discharge roller 13B located below.

Drive discharge roller 13A is arranged so that its lowermost position is substantially level with the upper surface of platen 6 being set when no recording paper P is passing (in the waiting mode) (see FIG. 5).

Follower discharge roller 13B is supported rotatably by platen 6 and is arranged so as to be in contact with the lowermost part of the drive discharge roller 13A when no recording paper P is passing therethrough (in the waiting mode).

In the operation of conveying recording paper P in this embodiment, while recording paper P is held between drive conveyer roller 62 and follower conveyer roller 63, lever 73 is pressing down platen 6 as described in the above first embodiment so as to keep the gap between recording head 52 and the opposing recording paper P surface at the designated distance L.

When the holding of recording paper P between these drive conveyer roller 62 and follower conveyer roller 63 is released, the downward thrust of lever 73 against platen 6 is also released. In this case, however as shown in FIG. 6, recording paper P is conveyed as it is being held between drive discharge roller 13A and follower discharge roller 13B, so that the follower discharge roller 13B is pressed down by the distance corresponding to the thickness of this recording paper P (in the direction of an arrow E in FIG. 6) hence platen 6 is also pressed down (in the direction of an arrow D in FIG. 6) as it rotates about support point A. Therefore, the gap between recording head 52 and the opposing recording paper P surface can be kept at the predetermined distance L.

In this way, in accordance with this embodiment, even after the holding of recording paper P between drive conveyer roller 62 and follower conveyer roller 63 has been released, the gap between recording head 52 and the recording paper P surface can be kept at the predetermined distance L. That is, it is possible to keep the gap between recording head 52 and the opposing recording paper P surface at the predetermined distance L until image forming over the entire surface of recording paper P is completed. Accordingly, in addition to the effects of the first embodiment, the present configuration is able to achieve beneficial image forming over the entire surface of recording paper P, thus further improving the image quality.

(The Third Embodiment)

Next, referring to FIGS. 7, 8A and 8B, the third embodiment of the present invention will be described. This embodiment is a variational example of platen clutching means 8. Hence, description here will be made as to only the configuration of platen clutching means 8 and its function.

Figure 7:
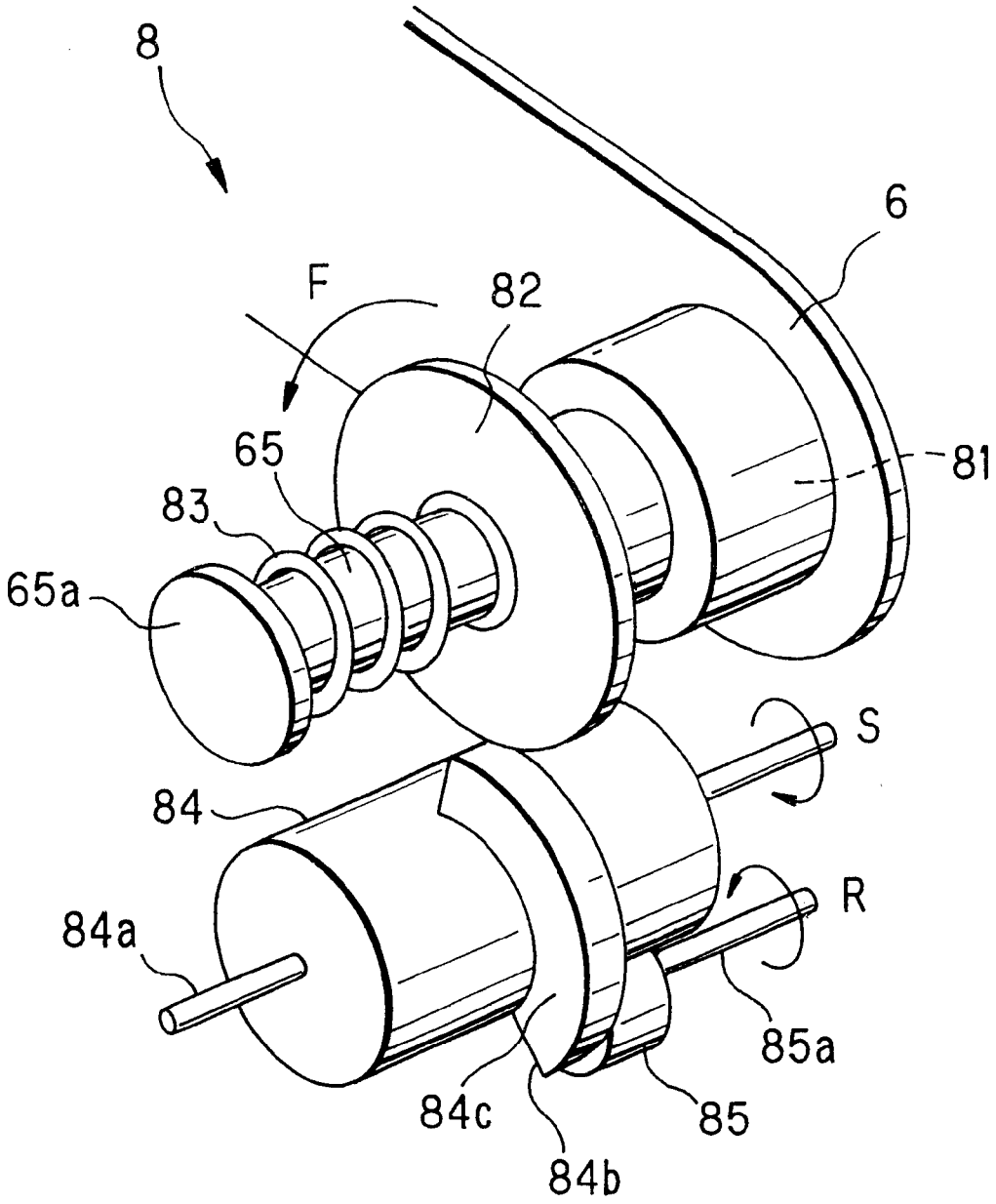
FIG. 7 is a perspective view showing a platen clutching means in accordance with the third embodiment.
Figure 8A:
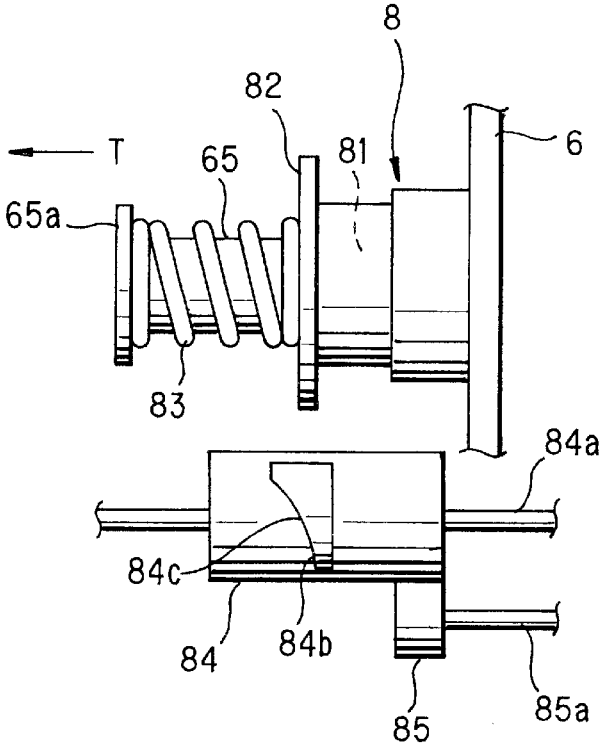
FIGS. 8A and 8B are views for illustrating the operation of a platen clutching means in accordance with the third embodiment.
Figure 8B:
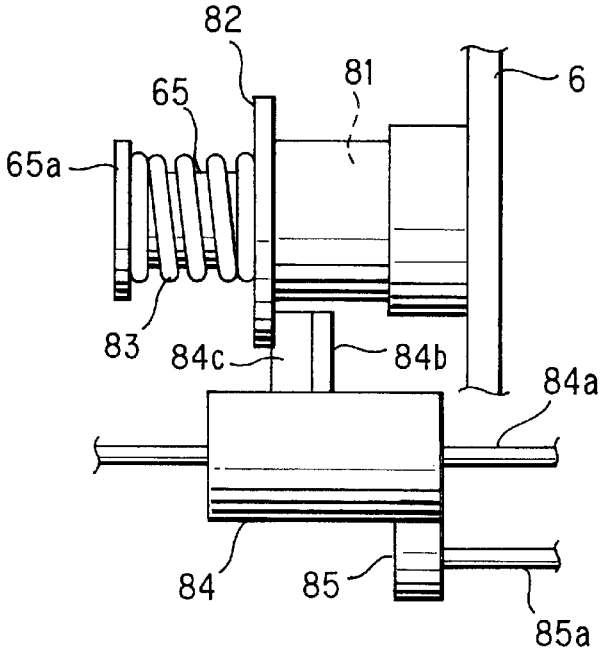

This embodiment, as shown in FIGS. 7, 8A and 8B, is characterized by inclusion of a one-way clutch mechanism as a movement direction limiting element disposed between platen 6 and a shaft 65 supporting the platen.

This one-way clutch mechanism is configured so that a one-way clutch 81 is fitted and fixed on shaft 65 that supports platen 6 with platen 6 fixed thereon. This one-way clutch 81 has a flange 82 integrally formed with it. Shaft 65 also has a flange 65*a* integrally formed at its one end. A compression coil spring 83 is compressively arranged between these flanges 82 and 65*a*. When flange 82 of one-way clutch 81 is positioned to the right side in FIGS. 8A and 8B by the thrust of this compression coil spring 83, one-way clutch 81 is set so as to be engaged (c.f. FIG. 8A). That is, in this state, platen 6 is permitted to rotate in one direction (i.e., in the direction of an arrow F in FIG. 7) only. When flange 82 is set to the left side in FIGS. 8A and 8B opposing the thrust from compression coil spring 83, one-way clutch 81 is set so as to be free (c.f. FIG. 8B). In other words, platen 6 is allowed to rotate freely in either direction.

Provided in proximity to this one-way clutch mechanism (at the lower side in the drawings) is a release roller 84 that is rotatable about a rotary shaft 84*a* extending in parallel to the above shaft 65. This release roller 84 has a releasing claw 84*b* on its outer peripheral side. This claw comes into sliding contact with flange 82 of one-way clutch 81 so as to set the clutching free. That is, this releasing claw 84*b* is formed with a slider surface 84*c* made up of a curved surface that can come into sliding contact with flange 82 so that as release roller 84 rotates this slider surface 84*c* thrusts flange 82 of one-way clutch 81 in the axial direction (to the left in FIGS. 8A and 8B).

Further, abutted on the outer peripheral side of the above release roller 84 is a drive roller 85 which rotates about a rotary shaft 85*a* that is in parallel with the axis of release roller 84. This drive roller 85 is adapted to rotate in linkage with the aforementioned pickup roller 11. Illustratively, when pickup roller 11 starts rotating to deliver a blank sheet of recording paper P from paper feed cassette 3, this drive roller 85 also starts rotating so that this rotational force is transmitted to release roller 84. In this way, release roller 84, as it receives the rotational force, rotates so that releasing claw 84*b* abuts against flange 82 of one-way clutch 81 to thereby achieve clutch disengagement. Thus, the releasing means termed in the present invention is constructed by using the above release roller 84 and drive roller 85.

The specific operation of this one-way clutch mechanism usually allows platen 6 to rotate in only the direction designated by arrow F in FIG. 7. When recording paper P passes over platen 6, the platen 6, receiving downward thrust, rotates in the direction designated by F, as in the case of the above first embodiment. During this, the pressing force from compression coil spring 66 acts on platen 6 so as to rotate it in the upward direction, but this rotation is stopped since one-way clutch 81 is in engagement. The state of platen 6 being deflected downward is thus maintained. This state continues even after the holding of recording paper P between drive conveyer roller 62 and follower conveyer roller 63 is released. In other words, even after leaving recording paper P from the nip between drive conveyer roller 62 and follower conveyer roller 63, the gap between recording head 52 and the opposing recording paper P surface can be kept at the aforementioned designated distance L.

In this way, when the image forming operation of a sheet of recording paper P has been completed and a next sheet of recording paper P is fed from paper feed cassette 3, pickup roller 11 rotates. Drive roller 85 also rotates (in the direction designated by an arrow R in FIG. 7) in linkage with the rotation of pickup roller 11. This rotational force is transmitted to release roller 84. Release roller 84, thus receiving this rotational force, rotates in the direction designated by an arrow S in FIG. 7) so that the slider surface 84*c* of releasing claw 84*b* abuts flange 82 of one-way clutch 81. As the amount of rotation of this release roller 84 becomes greater, releasing claw 84*b*, as it is abutting against flange 82 of one-way clutch 81, moves flange 82 in the direction designated by an arrow T in FIG. 8A, opposing the thrust from compression coil spring 83. As shown in FIG. 8B, when this amount of movement reaches the predetermined distance, the grip of one-way clutch 81 is released, whereby platen 6 is urged by the thrust from compression coil spring 66 and rotates upwards to the original position.

Thereafter, a further rotation of release roller 84 causes releasing claw 84*b* to depart from flange 82 of one-way clutch 81 so that one-way clutch 81 becomes engaged again. Thus, when platen 6 has rotated downwards upon passage of recording paper P over platen 6, the rotated state can be retained.

Repeated engagement and disengagement of one-way clutch 81 makes it possible to keep the gap between recording head 52 and the opposing recording paper P surface at the designated distance L during image forming only.

Thus, also in this embodiment, it is possible to keep the gap between recording head 52 and the opposing recording paper P surface at the predetermined distance L until image forming over the entire surface of recording paper P is completed. Accordingly, in addition to the effects of the first embodiment, the present configuration is able to achieve beneficial image forming over the entire surface of recording paper P, thus further improving the image quality.

(The Fourth Embodiment)

Next, the fourth embodiment of the present invention will be described. In the above embodiments heretofore, description has been made of the cases where the present invention is applied to a color ink-jet printer 1 in which recording paper P is conveyed along conveyance path H formed in an approximately U-shape. The embodiments to be described hereinbelow are the cases where the present invention is applied to a color ink-jet printer 1 in which recording paper P is conveyed along a conveyance path formed in an approximately J-shape and a platen actuating means 7 having a different configuration from that described above is employed.

Figure 9:
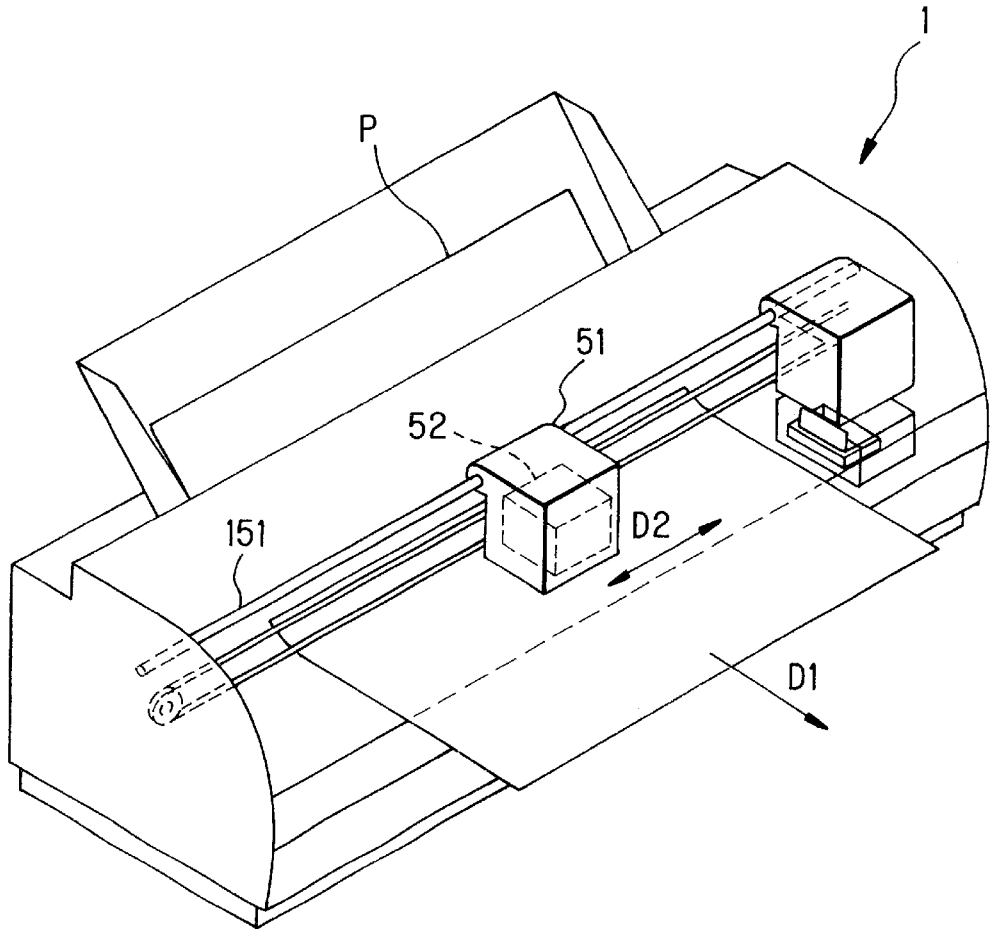
FIG. 9 is a perspective view showing the appearance of a color ink-jet printer while partly depicting its internal configuration in accordance with the fourth embodiment.
Figure 10:
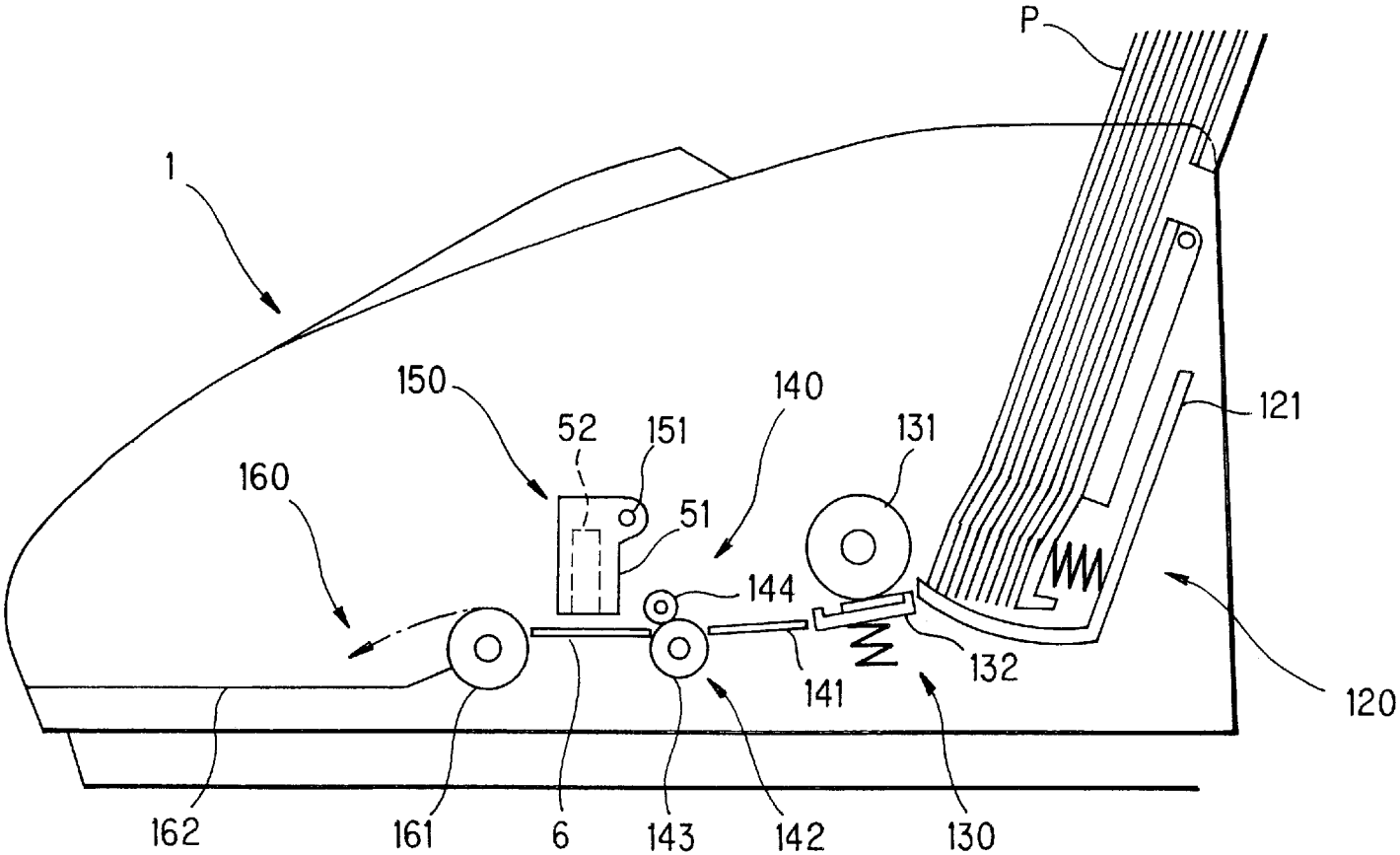
FIG. 10 is a view showing the internal configuration of a color ink-jet printer.

FIG. 9 is a perspective view showing the appearance of a color ink-jet printer 1 while partly depicting its internal configuration, in accordance with the present embodiment. FIG. 10 is a view showing the internal configuration of color ink-jet printer 1.

As understood from these drawings, ink-jet printer 1 according to this embodiment includes a paper feeder 120, a separating portion 130, a conveying portion 140, a printing portion 150 and a discharge portion 160.

Paper feeder 120 has a paper feed tray 121 extending almost upright and an unillustrated pickup roller. Upon print start a sheet of recording paper P is picked up from paper feed tray 121 by the pickup roller and delivered to separating portion 130. The paper feed tray 121 functions as a storage of recording paper P when the printer is not in operation.

Separating portion 130 is to deliver recording paper P supplied from paper feed tray 120, sheet by sheet, to printing portion 150, and is comprised of a paper feed roller 131 and separator 132. Separator 132 has a pad (attached at the contract area with recording paper P) which is designed to produce a greater friction with recording paper P than the friction between sheets of recording paper P. Paper feed roller 131 has a roller surface which is designed to produce a greater friction with recording paper P than the friction between the separator 132 pad and recording paper P and the friction between sheets of recording paper P. Therefore, even if a number of recording sheets P, P, . . . are picked up and delivered to separating portion 130, paper feed roller 131 is able to separate the topmost sheet of recording paper P from these multiple recording sheets P, P, . . . , to send it out to conveying portion 140.

Conveying portion 140 is to convey recording paper P, delivered sheet by sheet by separating portion 130, toward printing portion 150, and is composed of a guide plate 141 and paired conveyer rollers 142. These paired conveyer rollers 142 are to control conveyance of recording paper P so that ink droplets from a recording head 52 will be sprayed at correct positions on recording paper P when recording paper P is fed into the gap between recording head 52 and platen 6.

Printing portion 150 is to perform printing on the recording paper P delivered by paired conveyer rollers 142 of conveying portion 140 and is composed of recording head 52, a carriage 51 having this recording head 52 mounted thereon, a guide shaft 151 for guiding this carriage 51 along the main scan direction and platen 6 serving as a supporting table of recording paper P during printing.

Discharge portion 160 is to collect recording paper P after being printed, and is composed of an unillustrated ink dryer for drying ink on recording paper P and a paper discharge roller 161 and a paper output tray 162.

In the above arrangement, ink-jet printer 1 performs printing by the following sequence. First, an unillustrated computer or the like issues a print request of image information to ink-jet printer 1. Ink-jet printer 1 having received the print request causes the pickup roller to deliver recording paper P on paper feed tray 121 from paper feed portion 120. Then, the thus delivered recording paper P is conveyed through separator 130 by paper feed roller 131 to conveying portion 140. In conveying portion 140, recording paper P is guided by paired rollers 142 into the gap between recording head 52 and platen 6. In printing portion 150, ink droplets are sprayed (ejected) from the ink nozzles in recording head 52 onto recording paper P on platen 6 in accordance with the image information. During ink ejection, recording paper P is halted on platen 6. Whilst ink droplets are being sprayed, carriage 51 is guided along guide shaft 151 in the main scan direction (in the direction designated at D2 in FIG. 9) producing a single scan line. When one line is completed, recording paper P is moved on platen 6 by a predetermined distance in the auxiliary scan direction (in the direction designated at D1 in FIG. 9). In printing portion 150, the above cycle is repeated in accordance with the image data so as to complete printing the entire page of recording paper P. The thus printed recording paper P passes through the ink dryer and is discharged by discharge roller 161 to paper output tray 162. The resultant recording paper P is given as printed matter to the user.

Description of Platen Actuating Means 7

Next, the configuration of platen actuating means 7 of this embodiment will be described. The platen actuating means 7 in this embodiment is comprised of platen 6, paired rollers 142, compression coil spring 66, an adjuster element 170, a limiting structure 180, as shown in FIGS. 11 through 15.

Referring first to the sectional view in FIG. 11, platen 6, paired rollers 142 and compression coil spring 66 will be described.

Platen 6 functions as a supporting table of recording paper P during printing and has compression coil spring 66 attached on the underside. This compression coil spring 66 elastically supports platen 6 by its elastic deformation. That is, one end of compression coil spring 66 (the bottom end in FIG. 11) is fixed to the housing of ink-jet printer 1 and the other end (the top end in FIG. 11) is connected to the underside of platen 6. Therefore, platen 6 is constrained by compression coil spring 66 so that it can move only within the elastic deformable range of compression coil spring 66.

Paired rollers 142 are so-called PS rollers, which feed recording paper P into the gap between recording head 52 (both are not shown in FIG. 11) and platen 6, and are composed of a drive roller 143 and a follower roller 144. Drive roller 143 is a power transmission roller finished with an anti-slip treatment for stably conveying recording paper P. Follower roller 144 is a roller that is arranged opposing drive roller 143 and does not produce any driving force. This follower roller 144 is arranged so as to be movable in a direction perpendicular to its rotary axis(in the direction parallel to the document surface of FIG. 11).

Next, the arrangement of adjuster element 170 and the relationship between this adjuster element 170 and other components and the operation of adjuster element 170 will be described.

First, the arrangement of adjuster element 170 will be described. As shown in FIG. 11, adjuster element 170 provides a lever function. A pivot support 171, which extends perpendicularly to the document surface of FIG. 11 and joined to the housing of ink-jet printer 1, is provided at the position of the fulcrum of this lever. Accordingly, adjuster element 170 is able to pivot on this pivot support 171.

Further, this adjuster element 170 supports a rotary shaft of follower roller 144 at the position of the effort of the lever. That is, adjuster element 170 pivots on the pivot support 171 in accordance with the movement of follower roller 144.

Moreover, adjuster element 170 supports a platen shaft 6A of platen 6 at the position of the load of this lever. This platen shaft 6A is connected at one end of adjuster element 170 so that platen 6 can move in accordance with the rotation of adjuster element 170 or so as to rotate adjuster element 170 when platen 6 moves. Therefore, when adjuster element 170 rotates as follower roller 144 moves, platen 6 also moves.

Next, the relationship between adjuster element 170 and other components will be described. Platen 6 is able to move within the range of the elastic deformation of compression coil spring 66 when there exists no adjuster element 170. However, since adjuster element 170 constrains platen shaft 6A, platen 6 is adapted to move only when adjuster element 170 rotates.

The point of equilibrium of compression coil spring 66 can be adjusted by designating its natural length (the length when no load is applied) and its modulus of elasticity. Therefore, when platen 6 is constrained by platen shaft 6A as stated above, it is also possible to set up compression coil spring 66 such that compression coil spring 66 will not fall in equilibrium (such that compression spring 66 will produce a thrust on platen 6) however platen 6 would be moved. In the present embodiment, compression coil spring 66 is set so that it continuously urges platen 6 toward recording head 52.

Next, the function of adjuster element 170 will be explained. As to the function of adjuster element 170, the case in which movable follower roller 144 is upraised by applying a force thereto and the case in which the force applied to follower roller 144 is released are separately described.

Figure 11:
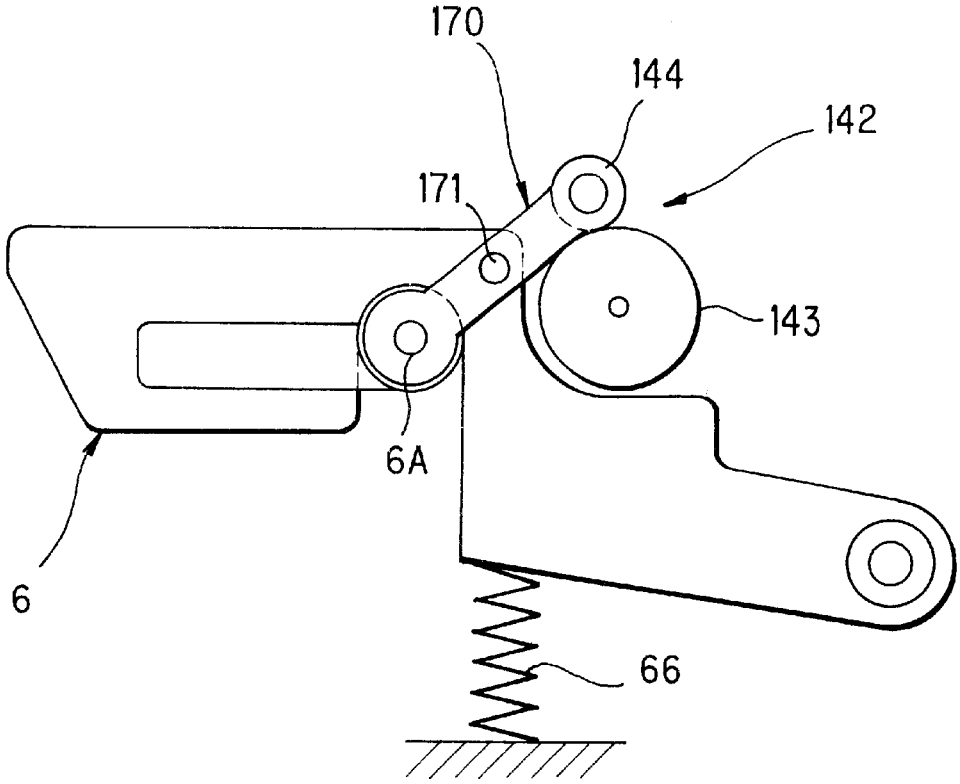
FIG. 11 is a side view for illustrating the operation of a platen actuating means in accordance with the fourth embodiment, with no recording paper passing.
Figure 12:
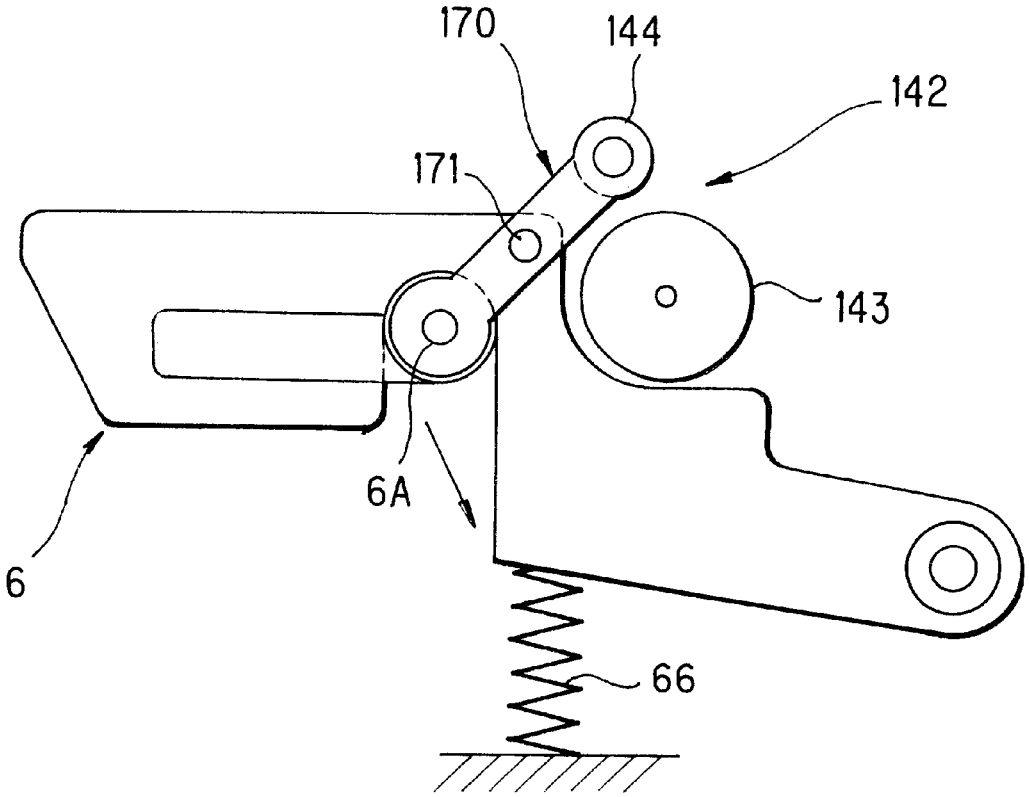
FIG. 12 is a side view for illustrating the operation of a platen actuating means in accordance with the fourth embodiment, with recording paper passing.

First, FIG. 12 shows the case in which follower roller 144 is upraised by applying a force. In this case, upraising follower roller 144 will produce a force causing adjuster element 170 to rotate counterclockwise in the drawing. Since the positions of drive roller 143 and pivot support 171 of adjuster element 170 are fixed to the housing of ink-jet printer 1, these points remain unmoved in FIGS. 11 and 12. In contrast, movable follower roller 144 moves as stated above, hence adjuster element 170 also turns counterclockwise in the drawing. When adjuster element 170 moves in such away, platen 6 constrained by platen shaft 6A also moves (see the arrow in FIG. 12).

In reality, the pressing force from compression coil spring 66 is applied to platen 6 or platen shaft 6A so as to cause adjuster element 170 to pivot in the clockwise direction in the drawing. Therefore, in order to rotate adjuster element 170 counterclockwise by moving follower roller 144, a force equal to or greater than this pressing force is required.

Resultantly, in FIG. 12, only when follower roller 144 is upraised by application of strong enough a force, adjuster element 170 rotates counterclockwise while platen 6 moves in the lower right direction in the drawing.

Next, the case where the force applied to follower roller 144 is released will be described. When the force applied to follower roller 144 is released from the above state, platen 6 moves upwards by the pressing force from compression coil spring 66 while adjuster element 170 pivots clockwise in the drawing. Adjuster element 170 as it rotates causes follower roller 144 to approach drive roller 143 until follower roller 144 comes into contact with drive roller 143. When follower roller 144 and drive roller 143 come in contact, adjuster element 170 stops rotating. Therefore, the movement of platen 6 stops.

In sum, when the force having upraised follower roller 144 is released from the state shown in FIG. 12 where follower roller 144 has been upraised, platen 6 moves up by compression coil spring 66 so that follower roller 144 and drive roller 143 return into the state shown in FIG. 11 where they are in contact with each other.

Next, gap adjustment with adjuster element 170 will be described. In the above arrangement, when recording paper P is nipped between paired rollers 142, follower roller 144 is upraised by the thickness of recording paper P (the state shown in FIG. 12). Therefore, adjuster element 170 turns in the counterclockwise direction in the drawing and platen 6 moves in the lower right direction. In this way, platen 6 is adapted to move in the direction away from recording head 52 during printing by the rotation of adjuster element 170. Accordingly, follower roller 144 moves by the distance corresponding to the thickness of recording paper P hence platen 6 also moves in proportion to the thickness of recording paper P. Thus, it is possible to move platen 6 in accordance with the thickness of the recording paper P.

In this embodiment, the position of pivot support 171 of adjuster element 170 is adjusted so that the distance of movement of platen 6 by the insertion of recording paper P into the nip between paired rollers 142 will be just equal to the thickness of recording paper P.

Figure 13:
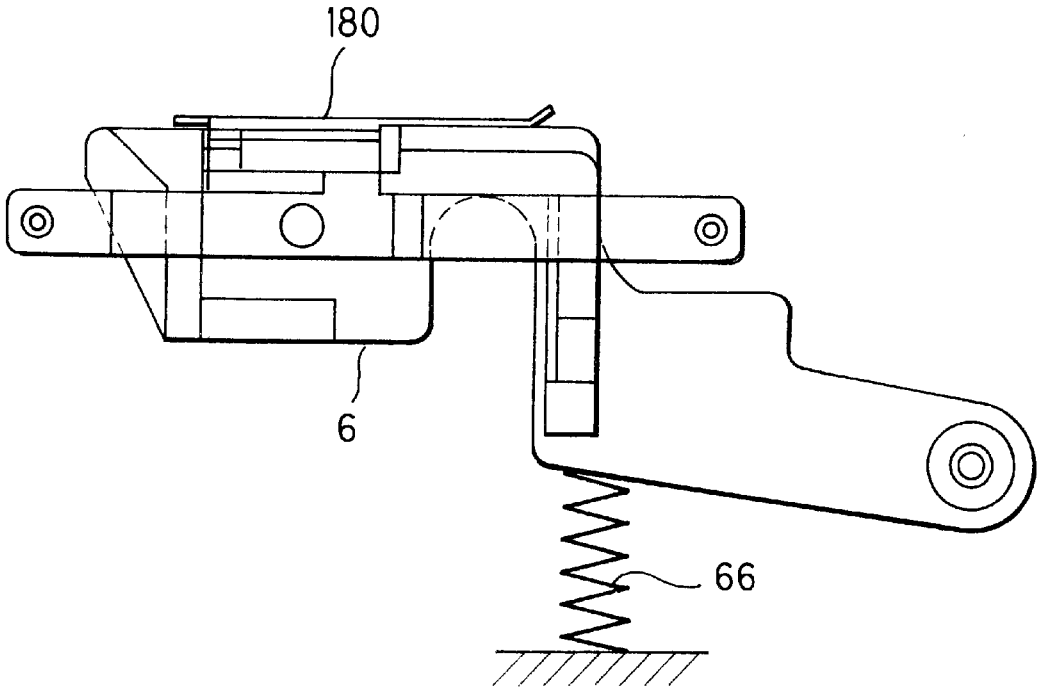
FIG. 13 is a side view showing the platen and its surroundings for explaining a limiting element.

Referring next to FIG. 13, limiting structure 180 will be described. Platen 6 shown in FIG. 13 is provided with a device keeping recording paper P on platen 6 a predetermined distance apart from the ink nozzles on recording head 52 (bowing regulating structure termed in the present invention) so as to cover part of the margin of recording paper P (not shown) on platen 6 which is adjacent to recording head 52 (shown for example in FIG. 1). Here, the margin indicates the surrounding adjacent to the edge of the recording paper P where no ink is sprayed from the ink nozzles where nothing is printed.

Figure 14:
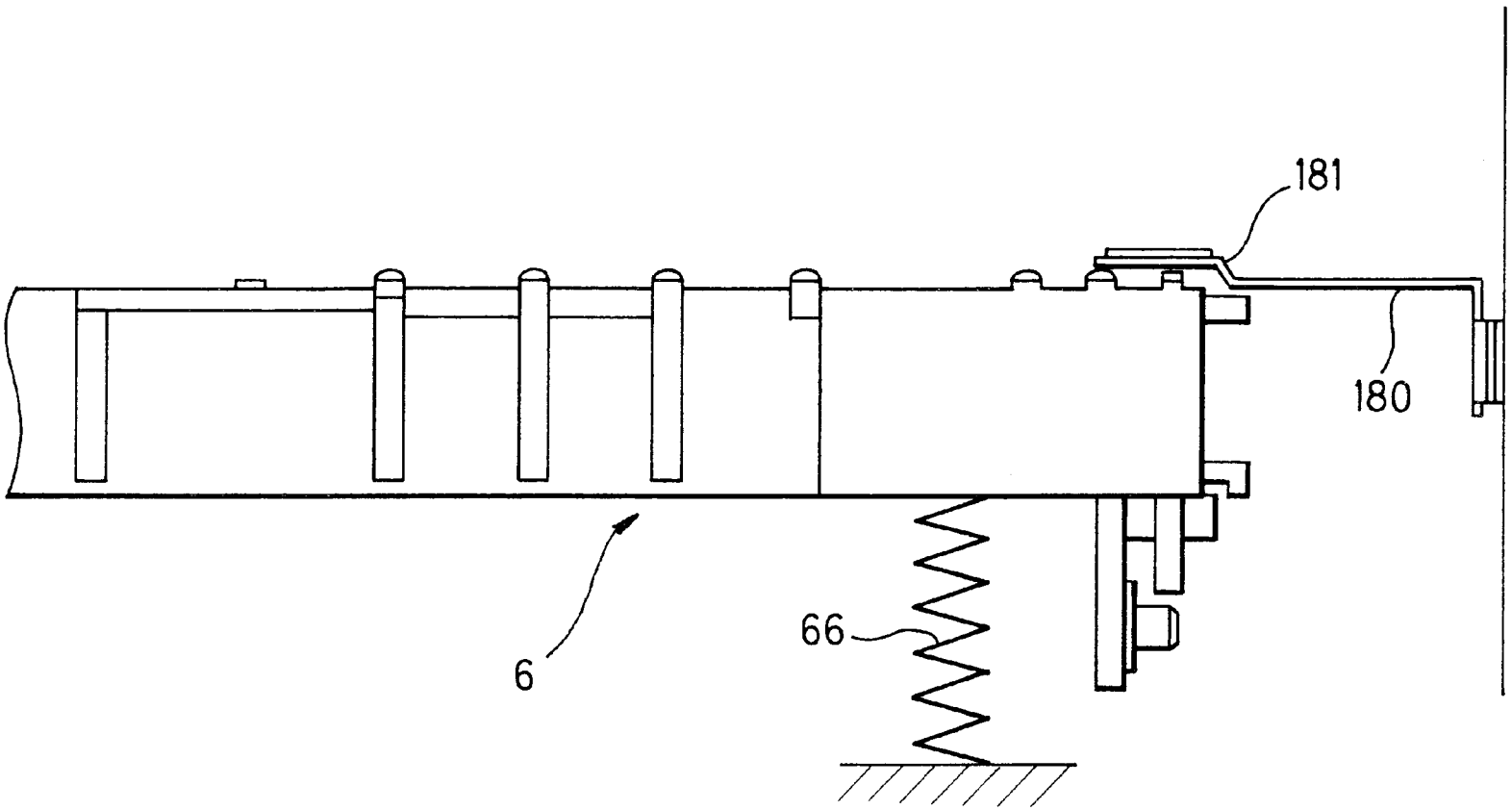
FIG. 14 is a front view showing the platen and its surroundings for explaining a limiting element.
Figure 15:
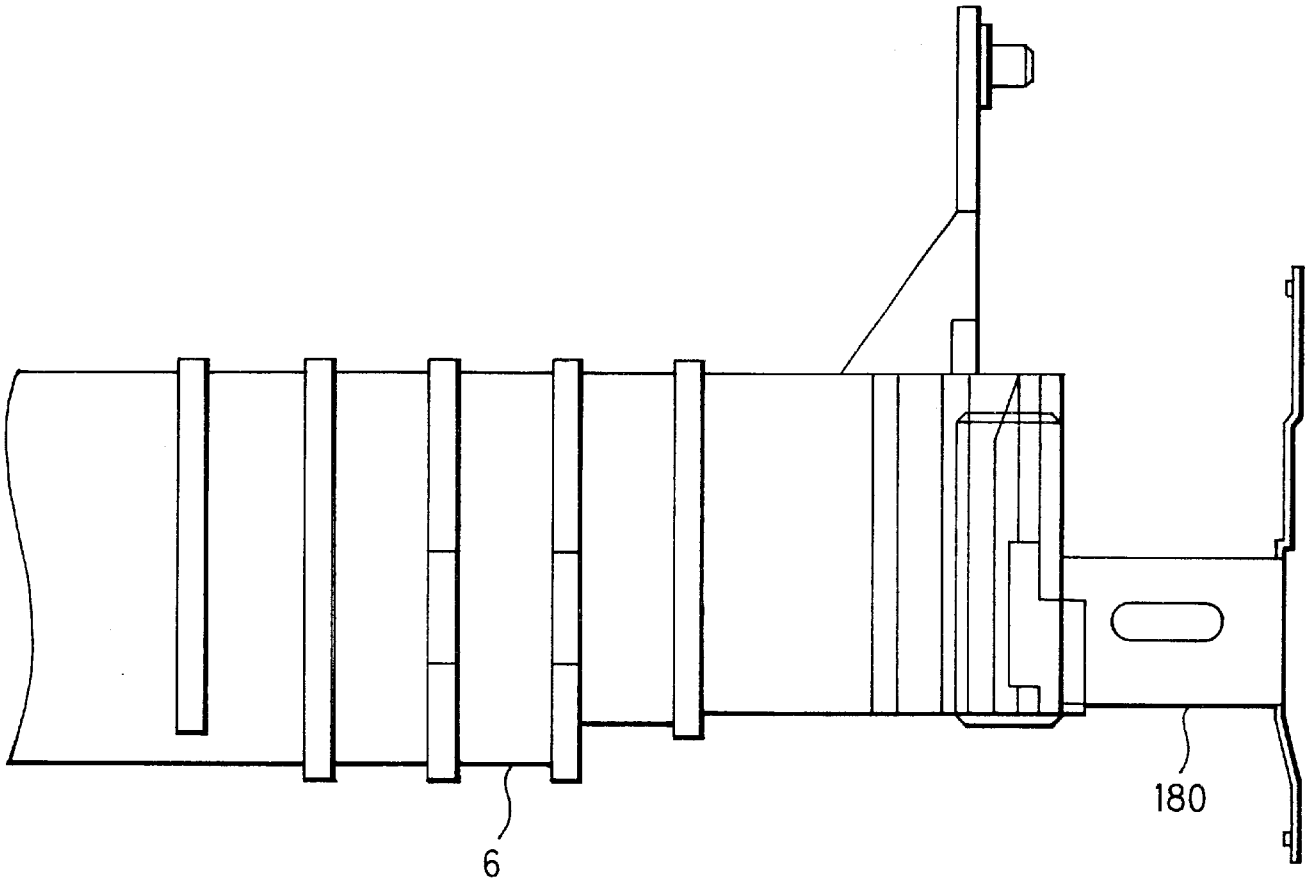
FIG. 15 is a plan view showing the platen and its surroundings for explaining a limiting element.

FIG. 14 is a sectional layout of platen 6 and limiting structure 180 shown in FIG. 13, viewed from the front side of ink-jet printer 1. In FIG. 14, recording paper P is conveyed in the direction perpendicular to the document surface. FIG. 15 is its plan view from top.

Platen 6 is adapted to move within the elastic deformation of compression coil spring 66 and under the constraint of platen shaft 6A, as described above. Platen 6 continuously receives upward thrust from compression coil spring 66.

In printing, recording paper P is fed onto platen 6 while limiting structure 180 is positioned so as to cover part of the margin of the recording paper P. Since the upward force from compression coil spring 66 is applied on platen 6, the part of the margin of recording paper P becomes inserted into the gap between platen 6 and limiting structure 180. Since platen 6 also serves as a backing element for keeping recording paper P flat, the recording paper P on platen 6 is kept flat. In short, recording paper P is set flat with the top surface of the boundary (margin) opposed to the underside of the rim of limiting structure 180. Therefore, in this arrangement, the upper surface of recording paper P is always positioned at the underside of the rim of limiting structure 180 which is fixed. In one word, the head to medium gap can be kept constant.

When the above limiting structure 180 is provided, it could occur that if the gap between this limiting structure 180 and platen 6 is too narrow, recording paper P cannot be conveyed properly or recording paper P may be bent. This can be avoided by the function of adjuster element 170 in this embodiment. That is, when recording paper P become nipped between paired rollers 142, follower roller 144 is moved in accordance with the thickness of recording paper P and hence adjuster element 170 pivots so that platen 6 is moved to the side away from recording head 52. Since limiting structure 180 is disposed on the side close to recording head 52 when viewed from platen 6, the above movement of platen 6 is made to the direction away from limiting structure 180 and by the distance corresponding to the thickness of recording paper P. Accordingly, it is possible to secure a proper gap between limiting structure 180 and platen 6 for recording paper P to pass therethrough.

For instance, there is a possibility that a very thin recording paper P insufficient in rigidity could not be fed into the gap between limiting structure 180 and platen 6 and might be bent. Such situations can be avoided by the above operation of platen actuating means 7. Resultantly, it is possible to perform stable printing even for a thin sheet of recording paper P.

Moreover, in the embodiment of the present invention, as shown in FIG. 14, limiting structure 180 is formed with a wall 181, termed as a feed direction regulating structure in the present invention, on which the recording paper P side parallel with the direction of conveyance is abutted. Accordingly, it is possible to prevent recording paper P from moving to one side or obliquely with respect to the due direction of conveyance of recording paper P or prevent recording paper P from skewing and moving zigzagedly, hence perform beneficial printing. It should be noted that the means for preventing recording paper P from skewing and moving zigzagedly by guiding the side of the recording paper P may be provided separately from limiting structure 180.

(The Fifth Embodiment)

Next, the fifth embodiment of the present invention will be described. The overall configuration of a color ink-jet printer 1 of this embodiment is almost the same as that described in the fourth embodiment. Therefore, only the difference from the fourth embodiment will be described.

Figure 16A:
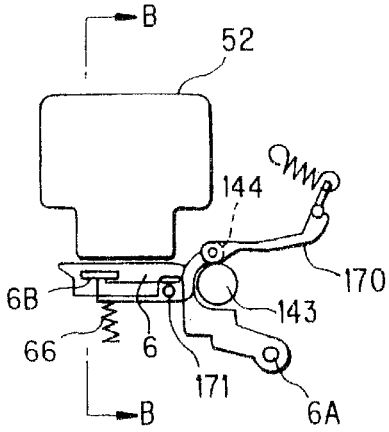
FIGS. 16A and 16B are views for illustrating the operation of a platen actuating means in accordance with the fifth embodiment, FIG. 16A being its side view showing a state where no recording paper is passing, FIG. 16B being its front view.
Figure 16B:
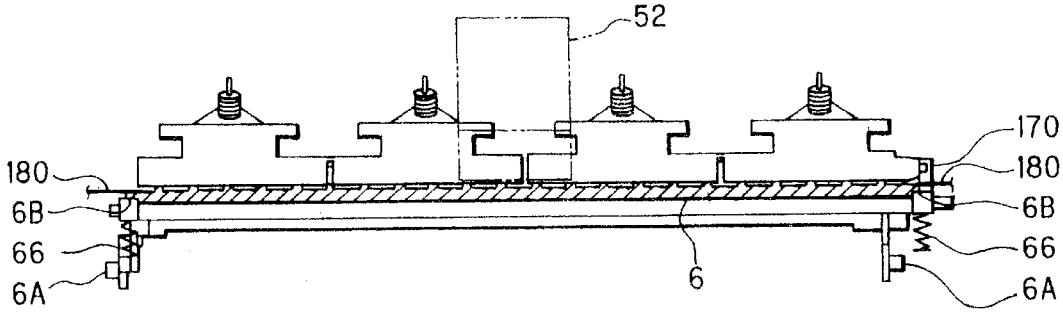

FIGS. 16A and 16B illustrate platen 6 and its surroundings, FIG. 16A being a side view and FIG. 16B being a sectional view, taken along a line B—B in FIG. 16A. As shown in these figures, platen actuating means 7 and other components adjacent to this of color ink-jet printer 1 of the present embodiment include platen 6, paired conveyer rollers 142 (made up of drive conveyer roller 143 and follower conveyer roller 144), compression coil spring 66, adjuster element 170 and limiting structure 180.

As shown in FIGS. 16A and 16B, platen 6 serves as a supporting table of recording paper P during printing, and is supported by platen shaft 6A joined to the housing of color ink-jet printer 1 similar to the above. This platen shaft 6A is positioned so that the gap between the head and recording paper can be assumed to be practically uniform across the printing range extending in the direction of paper conveyance. In the embodiment, the difference in head-recording paper gap within the printing range (the range in which ink nozzles are arrayed) in the recording paper direction of movement is set equal to or smaller than 0.1 mm. The distal end of adjuster element 170 functioning as the platen support is arranged at the underside of platen 6 so that adjuster element 170 supports platen 6 from the bottom. In practice, platen 6 is supported at two sites, i.e., at both ends of the platen 6 (the ends with respect to the main scan direction) so that all the points on the upper surface of platen 6 have the same height (that i.e., the upper surface of platen 6 is substantially horizontal) without the upper surface of platen 6 twisted. Compression coil spring 66 is arranged right below each of the support points. Two limiting elements 180, 180 are provided right above the support points so that the initial position of the upper surface of platen 6 is uniform. That is, these limiting elements 180, 180 constitute the platen position limiting structure termed in the present invention for limiting the platen 6 position so that the gap between the upper surface of platen 6 and recording head 52 will not be equal to or narrower than the designated distance.

Compression coil spring 66 is the element which moves adjuster element 170 by elastic deformation and its one end is fixed to the housing of ink-jet printer 1 while the other end is joined to the underside of adjuster element 170. Therefore, in this embodiment, adjuster element 170 is constrained by compression coil spring 66 so that it is movable within the range of elastic deformation of compression coil spring 66 only. In this embodiment, platen 6 is not attached to compression coil spring 66 but platen 6 merely rests on adjuster elements 170 supported by compression coil springs 66. Platen 6 supported by adjuster elements 170 follows adjuster elements 170 by gravity as adjuster elements 170 move down. That is, platen 6 is able to move only within the range of movement of adjuster elements 170.

Next, the arrangement of adjuster element 170, the relationship between adjuster element 170 and other components and the function of adjuster element 170 will be explained.

First, the arrangement of adjuster element 170 will be described. As in the above fourth embodiment, adjuster element 170 provides a lever function and is pivotable about a pivot support 171, and its one end rotatably supports a follower roller 144 while the other end supports a platen support position 6B on the underside of platen 6. This platen support position 6B is coupled to one end of adjuster element 170 so that platen 6 can be moved in accordance with the rotation of adjuster element 170 or so that adjuster element 170 will rotate when platen 6 moves.

Platen support position 6B is provided at each end of the platen so that the platen is supported by two adjuster elements 170. When adjuster elements 170 rotate about pivot support 171, the two support points of adjuster elements 170 move by the same amount so that the platen upper surface can be at any time maintained to be flat and uniform. Therefore, when follower conveyer roller 144 moves as recording paper P becomes nipped, adjuster elements 170 rotate, hence platen 6 moves while the upper surface of platen 6 is continuously kept flat and uniform.

Figure 17A:
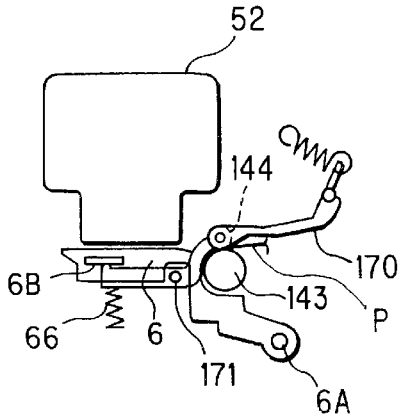
FIGS. 17A and 17B are views for illustrating the operation of a platen actuating means in accordance with the fifth embodiment, FIG. 17A being its side view showing a state where recording paper is passing, FIG. 17B being its front view.
Figure 17B:
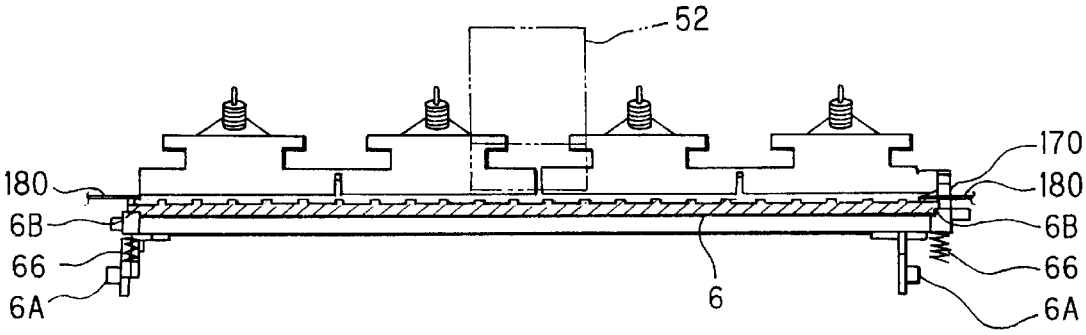

Next, the operation of gap adjustment by adjuster elements 170 will be described. As shown in FIGS. 17A and 17B, when recording paper P has become nipped between paired rollers 142, follower conveyer roller 144 is upraised by the thickness of recording paper P. Therefore, adjuster elements 170 turn in the counterclockwise direction and platen 6 moves down by gravity as adjuster elements 170 move down. In this way, adjuster elements 170 are adapted to move platen 6 in the direction away from recording head 52 during printing. As a result, follower conveyer roller 144 moves by a distance in proportion to the thickness of recording paper P, hence platen 6 is moved by the distance corresponding to the thickness of recording paper P. Thus, it is possible to move platen 6 in accordance with the thickness of the recording paper P.

In the present invention, when recording paper P has become nipped between paired conveyer rollers 142, the thickness of recording paper P will decrease slightly. In consideration of this fact, in order to set the distance of movement of platen 6 just equal to the thickness of recording paper P under recording head 52, the position of pivot support 171 of adjuster elements 170 is adjusted so that the distance of movement of platen 6 is 1.0 times to 1.5 times of the distance of movement of follower roller 144.

Figure 18A:
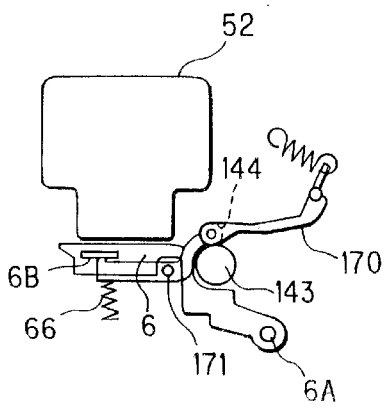
FIGS. 18A and 18B are views showing a case where the position of the platen is adjusted on one side only by an adjuster element, FIG. 18A being its side view, FIG. 18B being its front view.
Figure 18B:
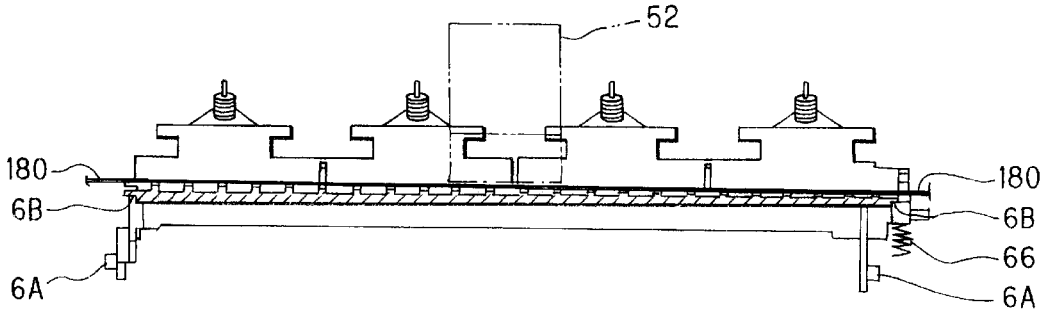

FIGS. 18A and 18B show a case where the position of the platen is adjusted by only one adjuster element 170 on one side of platen 6 with respect to its length. As understood from these figures, when the platen is supported on one side only, the head-paper gap on the supported side can be kept properly while the head-paper gap on the non-supported side becomes wider because the platen moves down by gravity. Hence, the head-paper gap varies across the length of platen 6 (along the recording media width), making it difficult to create uniform images.

In the present embodiment, platen 6 is supported at two platen support positions 6B, 6B or at both ends thereof, but three or more platen support positions 6B may be arranged. The configuration in which platen 6 is supported at three or more support sites should not be limited to this embodiment but can be applied to the other embodiments described heretofore.

Other Embodiments

The above embodiments have been described when the present invention is applied to a color ink-jet printer. However, the present invention can be applied to an ink-jet printer of monochrome printing.

Alternatively, it is possible to-use a sensor for measuring the thickness of recording paper P or the head to medium gap. Further, it is also possible to use a motor, etc., as a part of the control means for adjusting the head to medium gap in accordance with the distance measured.

In an ink-jet printer including platen actuating means 7 of each embodiment, those other than the platen actuating means 7 of the other embodiments can be applied interchangeably. For instance, limiting structure 180 and wall 181 of the fourth and fifth embodiments can be applied to the ink-jet printer 1 of the first embodiment, or the platen clutching means in accordance with the second and third embodiments may be applied to the ink-jet printers 1 of fourth and fifth embodiments.

As described heretofore, the configuration of the present invention uses a platen actuating means which moves the platen and makes adjustable the gap between the recording head and recording medium, whereby it is possible to keep constant the distance between the recording head and recording medium at any time regardless of the type (the thickness) of recording medium. Therefore, it is possible to always maintain the travel time of ink droplets from ejection from the recording head to the arrival onto the recording medium to be constant. As result, ink droplets can be distributed on the recording medium at correct places, thus making it possible to achieve improved image quality in image forming. It is also possible to avoid recording medium, during conveyance, interfering with the recording head and hence being mis-fed or damaging the recording head due to too short a gap between the recording head and the recording medium, thus making it possible to improve reliability of the image forming operation. Since, in the present invention, no adjustment as to the height or position of the carriage is performed to make the above gap distance uniform, the stability of the scanning movement of the carriage can be maintained without making the whole carriage system complex, hence it is possible to improve the image quality in image forming. In addition, the carriage height adjustable configuration also needed a height adjustable maintenance station or other alternative means, but the present invention does not need such arrangement so that it is possible to simplify the total machine configuration.

As another configuration, a platen support structure which places the platen thereon is provided so that the platen can move down by gravity when this platen support structure is moved down away from the recording head. Thereby the gap between the recording head and recording medium can be set at the predetermined distance. This configuration also has the same effects as the above configuration.

In the configuration where the gap between the recording head and recording medium is set at a predetermined distance by actuating the platen in linkage with the holding operation of a recording medium between paired conveyer rollers, it is possible to produce the above effects with a relatively simple configuration which does not need extra drive source such as a motor etc. Thus, this configuration is able to provide a practicable platen actuating means.

In the configuration where the paired conveyer rollers are arranged upstream of the recording head with respect to the conveying direction of recording media, the recording medium has already been held between the paired conveyer rollers when the recording medium reaches the position where it opposes the recording head. That is, image forming by ink droplets being ejected from the recording head to the recording medium is carried out when the platen movement in linkage with the holding between these paired conveyer rollers has been completed. As a result, it is possible to perform beneficial image forming from the leading part of the recording medium.

In the configuration including a platen clutching means for holding the platen, which has been moved by the platen actuating means, at that shifted position, the shifted position of the platen can be retained by the platen clutching means even after the holding of the recording medium between the paired conveyer rollers is released. Therefore, it is possible to keep the proper gap from the recording medium to the recording head even at the rear part of the recording medium (the upstream part with respect to the conveying direction), hence it is possible to perform beneficial image forming.

In the configuration including a movement limiting means for limiting the amount of movement of the platen by the platen actuating means, it is possible to avoid platen deformation which would be caused when the platen moved further than needed. Accordingly, it is possible to improve the apparatus reliability and lengthen the apparatus life.

Further, in the case where a bowing regulating structure for preventing the gap between the recording head and the surface of the recording medium being conveyed over the platen from becoming smaller than the designated distance is provided, the head to medium gap can be kept equal to or greater than the constant distance. This provides an assisting function for setting the head to medium gap properly, hence contributes to more stable image forming.

Finally, in the case where a feed direction regulating structure, made up of side edges which extend in the feed direction of the recording medium being conveyed over the platen and abut against the medium for preventing the recording medium from skewing or being fed zigzagedly, is provided, it is possible to prevent the recording medium from moving sidewards or obliquely. As a result, it is possible to perform image forming always under fixed conditions whilst the recording medium being stably conveyed.

What is claimed is:

1. An ink-jet type image forming apparatus comprising:

a platen for guiding recording media the platen having means on its top surface for receiving a roller;

a recording head disposed opposite to the platen for ejecting ink droplets onto recording media, means for actuating the platen which moves the platen so as to adjust a gap between the recording head and the recording medium;

paired conveyer rollers for holding the recording medium being image formed by ejected ink droplets from the recording head and conveying it, wherein the means for actuating the platen moves the platen in linkage with a holding operation of the recording medium between the paired conveyer rollers and sets the gap between the recording head and the recording medium at a predetermined distance; and further comprising a platen clutching means in which one of a paired discharge rollers arranged on the output side of the platen is rotationally supported by the platen so as to keep the platen at a position at which the platen has been shifted by the means for actuating the platen, wherein the paired discharge rollers are adapted to hold the recording medium and convey it when the holding of the recording medium by the paired conveyor rollers is released.

2. The ink-jet type image forming apparatus according to claim 1, wherein the means for actuating the platen is configured to move the platen so as to keep the gap between the recording head and the recording medium always constant regardless of the thickness of the recording medium.

3. The ink-jet type image forming apparatus according to claim 1, wherein the means for actuating the platen is configured to move the platen so as to keep the gap between the recording head and the recording medium always constant regardless of the thickness of the recording medium.

4. The ink-jet type image forming apparatus according to claim 1, wherein the means for actuating the platen, in linkage with the movement of the paired conveyer rollers separating from one another by the thickness of the recording medium when a recording medium is held between the paired conveyers rollers, moves the platen by the distance substantially corresponding to the movement of separation to thereby set the gap between the recording head and the recording medium at the predetermined distance.

5. The ink-jet type image forming apparatus according to claim 4, wherein the paired conveyer rollers are arranged at a position upstream of the recording head with respect to the direction of conveyance of the recording medium.

6. The ink-jet type image forming apparatus according to claim 1, wherein the means for actuating the platen, using the force arising when the paired conveyer rollers separate from one another by the thickness of the recording medium when a recording medium is held between the paired conveyers rollers, drives the platen by the distance substantially corresponding to the movement of separation to thereby set the gap between the recording head and the recording medium at the predetermined distance.

7. The ink-jet type image forming apparatus according to claim 6, wherein the paired conveyer rollers are arranged at a position upstream of the recording head with respect to the direction of conveyance of the recording medium.

8. The ink-jet type image forming apparatus according to claim 1, wherein the paired conveyor rollers are arranged at a position upstream of the recording head with respect to the direction of conveyance of the recording medium.

9. The ink-jet type image forming apparatus according to claim 1, wherein the means for actuating the platen includes a linkage mechanism for linking the platen actuating movement with the movement of the paired conveyer rollers separating one from the other.

10. The ink-jet type image forming apparatus according to claim 9, wherein the linkage mechanism includes: a first linkage for axially supporting a first conveyer roller of the paired conveyer rollers; and a second linkage which is coupled with the first linkage and presses and moves the platen in linkage with the movement of the first linkage as the first conveyer roller moves when a recording medium is held by the paired conveyer rollers.

11. The ink-jet type image forming apparatus according to claim 9, wherein the paired conveyer rollers comprise a drive roller and follower roller, the linkage mechanism has an adjuster element which is pivotally supported by the machine housing with its one end rotatably supporting the follower roller and the other end coupled with the platen, and when a recording medium is held between the paired conveyer rollers, the follower roller moves by the thickness of the medium relative to the drive roller, whereby the adjuster element pivots following the movement of the follower roller to cause the platen to move away from the recording head.

12. The ink-jet type image forming apparatus according to claim 11, wherein the adjuster element is configured so that the distance of movement of the platen with the rotation of the adjuster element is equal to the thickness of the recording medium.

13. The ink-jet type image forming apparatus according to claim 1, wherein a feed direction regulating structure on which the recording paper side parallel with the direction of conveyance of the recording paper being conveyed over the platen is abutted to the platen, is provided, so as to prevent the recording paper from skewing or moving zigzagedly.

14. An ink-jet type image forming apparatus comprising:

a platen for guiding recording media, a recording head disposed opposing the platen for ejecting ink droplets onto recording media, means for actuating the platen which moves the platen so as to adjust a gap between the recording head and the recording medium, and further comprising a platen clutching means for keeping the platen at a position at which the platen has been shifted by the means for actuating a platen, wherein the platen clutching means is comprised of paired discharge rollers arranged on the output side of the platen and is configured such that one of the discharge rollers is rotationally supported by the platen.

15. An ink-jet type image forming apparatus comprising:

a platen for guiding recording media, a recording head disposed opposing the platen for ejecting ink droplets onto recording media, means for actuating the platen which moves the platen so as to adjust a gap between the recording head and the recording medium, and further comprising a platen clutching means for keeping the platen at a position at which the platen has been shifted by the means for actuating a platen, wherein the platen clutching means has a movement direction limiting element which allows the platen to move only in the direction away from the recording head.

16. The ink-jet type image forming apparatus according to claim 15, wherein the platen clutching means has a releasing means for releasing the constraint imposed by the movement direction limiting element so as to allow the platen to move closer and back to the recording head.

17. The ink-jet type image forming apparatus according to claim 16, wherein the releasing means is comprised of a release roller put in sliding contact with the movement direction limiting element and a drive roller rotating the release roller in linkage with the paper feed roller, and the constraint imposed by the movement direction limiting element is released by the release roller sliding into contact with the movement direction limiting element as the drive roller turns in linkage with the movement of the paper feed roller.

18. The ink-jet type image forming apparatus according to claim 15, wherein the movement direction limiting element is comprised of a one-way clutch mechanism.

19. An ink-jet type image forming apparatus comprising:

a platen for guiding recording media, a recording head disposed opposing the platen for ejecting ink droplets onto recording media, means for actuating the platen which moves the platen so as to adjust a gap between the recording head and the recording medium, and a movement limiting means for limiting the amount of movement of the platen by the means for actuating the platen, wherein the platen actuating means has a linkage mechanism for coupling the movement of the platen in linkage with the movement of the paired conveyer rollers when they separate from one another, and the movement limiting means abuts the linkage mechanism to limit the movement of the linkage mechanism.

20. An ink-jet type image forming apparatus comprising:

a platen for guiding recording media, a recording head disposed opposing the platen for ejecting ink droplets onto recording media, means for actuating the platen which moves the platen so as to adjust a gap between the recording head and the recording medium, said means for actuating the platen includes a platen support structure for supporting the platen by placement thereon, so that the platen will move down by gravity as the platen support structure moves down away from the recording head, to thereby set the gap between the recording head and the recording medium at a predetermined distance, further comprising:

paired conveyer rollers for holding a recording medium therebetween conveying the recording medium being image formed by ejected ink droplets from the recording head and conveying it;

a thickness detecting means for detecting the thickness of the recording medium from the clearance between the conveyer rollers when a recording medium has been held between the pairs of rollers, said platen actuating means moves the platen support structure downward based on the thickness of the recording medium detected by the thickness detecting means and sets the gap between the recording head and the recording medium at a predetermined distance, wherein the paired conveyer rollers comprise a drive roller and follower roller, an adjuster element which is pivotally supported by the machine housing with its one end rotatably supporting the follower roller and the other end coupled with the platen support structure is provided, and when a recording medium is held between the paired conveyer rollers, the follower roller moves by the thickness of the medium relative to the drive roller, whereby the adjuster element pivots following the movement of the follower roller so that the platen support structure moves downward to thereby set the gap between the recording head and the recording medium at the predetermined distance.

21. The ink-jet type image forming apparatus according to claim 20, wherein the adjuster element is configured so as to cause the platen support structure to move downwards one to one and half times greater than the distance of movement of the follower roller relative to the drive roller.

* * * * *